US010980392B2

(12) United States Patent
Disch et al.

(10) Patent No.: US 10,980,392 B2
(45) Date of Patent: Apr. 20, 2021

(54) DISHWASHER IN THE FORM OF A COMMERCIAL UTENSIL WASHER OR DISHWASHER WHICH IS DESIGNED AS A BATCH DISHWASHER

(71) Applicant: ILLINOIS TOOL WORKS INC., Glenview, IL (US)

(72) Inventors: Harald Disch, Elzach (DE); Adrian Boldt, Offenburg-Bühl (DE)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 16/777,978

(22) Filed: Jan. 31, 2020

(65) Prior Publication Data

US 2020/0163521 A1 May 28, 2020

Related U.S. Application Data

(63) Continuation of application No. 15/741,888, filed as application No. PCT/US2016/042889 on Jul. 19, 2016, now Pat. No. 10,588,477.

(30) Foreign Application Priority Data

Jul. 23, 2015 (DE) ..... 10 2015 111 994.3

(51) Int. Cl.
*A47L 15/00* (2006.01)
*A47L 15/42* (2006.01)

(52) U.S. Cl.
CPC ..... *A47L 15/0078* (2013.01); *A47L 15/0081* (2013.01); *A47L 15/4248* (2013.01); *A47L 15/4219* (2013.01)

(58) Field of Classification Search
None
See application file for complete search history.

(56) References Cited

U.S. PATENT DOCUMENTS 2,947,311 A 8/1960 Fox
3,059,653 A 10/1962 Ingolia
(Continued)

FOREIGN PATENT DOCUMENTS

CN 101203333 A 6/2008
CN 101366619 2/2009
(Continued)

OTHER PUBLICATIONS

PCT, International Search Report and Written Opinion, International Application No. PCT/US2016/042889; dated Sep. 21, 2016, 12 pages.

*Primary Examiner* — Rita P Adhlakha
(74) *Attorney, Agent, or Firm* — Thompson Hine LLP

(57) ABSTRACT

A batch dishwasher is realized as a hood-type dishwasher having a treatment chamber (2) with at least one recirculating wash system for spraying wash liquid in the treatment chamber (2), and has at least one final rinse system for spraying final rinse liquid in the treatment chamber (2). The treatment chamber (2) has a first treatment zone (6) and at least one further, second treatment zone (7), wherein items of washware can be treated independently of one another and at least temporarily at the same time in the first and in the at least one second treatment zone (6, 7). The two treatment zones (6, 7) are physically separated from one another by a partition (50) such that when wash liquid is sprayed in one of the two treatment zones (6, 7), recontamination in the other treatment zone (7, 6) is effectively prevented.

14 Claims, 16 Drawing Sheets

(56) References Cited

U.S. PATENT DOCUMENTS

| | | | |
|---|---|---|---|
| 3,288,154 | A | 11/1966 | Jacobs |
| 4,088,145 | A | 5/1978 | Noren |
| 4,134,414 | A | 1/1979 | Jarvis |
| 4,146,405 | A | 3/1979 | Timmer |
| 5,934,298 | A | 8/1999 | Singh |
| 6,491,049 | B1 | 12/2002 | Tuller |
| 8,043,437 | B1 | 10/2011 | Delgado |
| 8,394,204 | B2 | 3/2013 | Buerkle |
| 9,743,821 | B2 | 8/2017 | Baldwin |
| 2004/0007256 | A1 | 1/2004 | Durazzani |
| 2004/0244825 | A1 | 12/2004 | Ashton |
| 2006/0237047 | A1 | 10/2006 | Bigott |
| 2006/0260656 | A1 | 11/2006 | Riggleman |
| 2007/0023069 | A1 | 2/2007 | Golightly |
| 2007/0124004 | A1 | 5/2007 | King |
| 2008/0035175 | A1 | 2/2008 | Varacins |
| 2008/0289655 | A1 | 11/2008 | Buerkle |
| 2009/0151750 | A1 | 6/2009 | Ecker |
| 2011/0017234 | A1 | 1/2011 | Lehmann |
| 2011/0017235 | A1 | 1/2011 | Berner |
| 2011/0094544 | A1 | 4/2011 | Fabin |
| 2011/0132403 | A1 | 6/2011 | Buerkle |
| 2012/0031432 | A1 | 2/2012 | Beaudet et al. |
| 2012/0138092 | A1 | 6/2012 | Ashrafzadeh |
| 2013/0056039 | A1 | 3/2013 | Hartz |
| 2013/0269736 | A1 | 10/2013 | Baldwin |
| 2014/0000665 | A1 | 1/2014 | Graven |
| 2015/0122290 | A1 | 5/2015 | Disch |
| 2016/0100737 | A1 | 4/2016 | Kramer |
| 2016/0113478 | A1 | 4/2016 | Disch |
| 2017/0071440 | A1 | 3/2017 | Berner |
| 2017/0143182 | A1 | 5/2017 | Disch |
| 2017/0367557 | A1 | 12/2017 | Lorenzi |
| 2017/0367577 | A1 | 12/2017 | Anim-Mensah |
| 2018/0199792 | A1 | 7/2018 | Berner |
| 2018/0206695 | A1 | 7/2018 | Disch |

FOREIGN PATENT DOCUMENTS

| | | | |
|---|---|---|---|
| CN | 101925322 | A | 12/2010 |
| CN | 101998839 | | 3/2011 |
| CN | 102105093 | | 6/2011 |
| CN | 102137613 | A | 7/2011 |
| CN | 201987507 | U | 9/2011 |
| CN | 201987508 | U | 9/2011 |
| CN | 102512128 | B | 6/2012 |
| CN | 203016901 | | 6/2013 |
| CN | 103565384 | A | 2/2014 |
| CN | 203970954 | | 12/2014 |
| CN | 104352209 | A | 2/2015 |
| CN | 205758480 | U | 12/2016 |
| DE | 2304035 | | 8/1974 |
| DE | 10004454 | | 8/2001 |
| DE | 10058410 | | 9/2002 |
| DE | 102004046758 | | 4/2006 |
| DE | 10 2005 023 429 | | 11/2006 |
| DE | 60030582 | | 9/2007 |
| DE | 102006062071 | | 7/2008 |
| DE | 20 2009 004 771 | | 9/2010 |
| DE | 102011054150 | | 6/2012 |
| DE | 102011084917 | | 4/2013 |
| DE | 102013101661 | | 10/2013 |
| DE | 102012207565 | | 11/2013 |
| DE | 20 2014 010 365 | | 5/2015 |
| DE | 10 2015 203 127 | | 9/2015 |
| DE | 102014208813 | | 11/2015 |
| DE | 102015111883 | | 1/2017 |
| DE | 102015111994 | | 1/2017 |
| EP | 1723887 | A2 | 11/2006 |
| EP | 1790274 | | 5/2007 |
| EP | 2491844 | A2 | 8/2012 |
| FR | 1480946 | | 5/1967 |
| FR | 2640487 | | 6/1990 |
| GB | 1248159 | | 9/1971 |
| JP | H0975290 | A | 3/1997 |
| JP | 2000 166849 | | 6/2000 |
| JP | 2002253470 | | 9/2002 |
| WO | WO 01/93741 | | 12/2001 |
| WO | WO 2011/128804 | | 10/2011 |
| WO | WO 2013090443 | | 6/2013 |
| WO | WO 2013169548 | | 11/2013 |
| WO | WO 2014/186182 | | 11/2014 |
| WO | WO 2015/138545 | | 9/2015 |
| WO | WO 2017015254 | | 1/2017 |
| WO | WO 2017015256 | | 1/2017 |

DISHWASHER IN THE FORM OF A COMMERCIAL UTENSIL WASHER OR DISHWASHER WHICH IS DESIGNED AS A BATCH DISHWASHER

TECHNICAL FIELD

The invention relates to a dishwasher in the form of a commercial utensil washer or dishwasher which is designed as a batch dishwasher.

BACKGROUND

Batch dishwashers are manually loadable and unloadable dishwashers. Batch dishwashers (also referred to as "box-type warewashers") may be a dish-rack-type pass-through dishwasher, also referred to as hood-type dishwashers ("hood-type warewashers") or front loaders ("front loader warewashers"). Front loaders may be undercounter machines, countertop machines or free-standing dishwashers with front loading configuration ("free standing front loaders").

A dishwasher in the form of a batch dishwasher normally has a treatment chamber for the cleaning of items of washware. In general, below the treatment chamber, there is arranged a wash tank into which liquid can flow back from the treatment chamber under the action of gravitational force. In the wash tank there is situated wash liquid, commonly water, to which detergents may be added if appropriate.

A dishwasher in the form of a batch dishwasher normally furthermore has a wash system with a wash pump, with a line system connected to the wash pump, and with a multiplicity of spray nozzles formed on at least one wash arm. The wash liquid situated in the wash tank can, by way of the wash pump, be delivered via the line system to the wash nozzles and sprayed through the wash nozzles in the treatment chamber onto the items of washware to be cleaned. The sprayed wash liquid subsequently flows back into the wash tank.

A dishwasher of said type in the form of a batch dishwasher is known for example from the document DE 10 2005 023 429 A1.

The expression "washware" used herein is to be understood in particular to mean dishes, glasses, cutlery, cooking utensils, baking utensils and serving trays.

The invention relates in particular to a dishwasher in the form of a commercial utensil washer or dishwasher which is designed as a batch dishwasher and is realized as a hood-type or pass-through dishwasher, wherein the dishwasher has a treatment chamber with at least one wash system, which is designed as a recirculation system.

Dishwashers of said type are used primarily (but not exclusively) in relatively small sculleries, for example in the case of relatively small cafeterias, in particular school cafeterias, or in the catering sector. What is characteristic of the use of such dishwashers is that they are used in sculleries in which, in general, only a limited installation area is available.

A commercial dishwasher in the form of a batch dishwasher, in particular hood-type or pass-through dishwasher, differs from a domestic dishwasher in particular in that a commercial dishwasher must be designed such that—depending on the selected treatment programme—programme running times of between one and five minutes can be realized, whereas domestic dishwashers generally have running times of up to 2.5 hours or longer. Owing to the short programme duration that is required in the case of commercial dishwashers, techniques used in domestic dishwashers generally cannot be readily transferred to commercial dishwashers.

Commercial dishwashers in the form of batch dishwashers normally operate in two main process steps: a first step, which comprises washing using a wash liquid, and a second step, which comprises final rinse using heated freshwater and dosed rinsing agent.

To be able to perform these process steps, a commercial dishwasher in the form of a batch dishwasher is generally equipped with two independent liquid systems. One liquid system is a wash water circuit which is responsible for the washing of the items of washware, wherein the washing is performed using recirculated water from the wash tank of the dishwasher. The other liquid system is a fresh water system which is responsible for the final rinse. The final rinse is performed using fresh water, preferably with fresh water from a water heater (boiler). The freshwater, after being sprayed, is likewise received in the wash tank of the dishwasher.

It is the main object of the final rinse to remove soapy water situated on the items of washware. Furthermore, the final rinse water that flows into the wash tank during the final rinse step serves for the regeneration of the wash water present in the wash tank.

Before fresh water as final rinse liquid is sprayed and is thus conducted into the wash tank of the dishwasher as a result of the final rinse process, an amount of wash liquid equivalent to the fresh water amount is pumped out of the wash tank.

Normally, commercial dishwashers in the form of batch dishwashers are equipped with multiple programmes. Said programmes differ primarily in terms of different lengths of programme running times of the washing process. The operator has the option to select a short wash programme in the case of lightly soiled items of washware or to select a correspondingly longer wash programme in the case of heavily soiled items of washware.

Commercial dishwashers which are in the form of batch dishwashers and which are designed for the batchwise loading and unloading of the treatment chamber with items of washware are in particular front-door machines or rack-type pass-through machines. In the case of front-door machines, the items of washware are placed into a rack, and the rack laden with items of washware is placed into the treatment chamber of the dishwasher through a front door and, after the cleaning process, is removed again through the front door. In the case of rack-type pass-through machines, the dish racks laden with items of washware are pushed manually into the treatment chamber from an entrance side and, after the end of a wash programme, are manually removed from the treatment chamber at an exit side. Front-door machines and rack-type pass-through machines comprise only a single treatment chamber for the treatment of the items of washware. Front-door machines may be undercounter machines or countertop machines.

Almost without exception, commercial dishwashers which are in the form of batch dishwashers and which are designed for the batchwise loading and unloading of the treatment chamber with items of washware are designed with infeed and/or run-out tables. On the infeed side of the dishwasher, it is normally the case that manual clearing and manual pre-washing of the soiled items of washware are performed. Furthermore, here, the soiled items of washware are loaded into special dish racks. The run-out side serves for the drying and unloading of the dish racks.

In particular in the case of dishwashers in the form of hood-type machines or rack-type pass-through machines, the washing plane is normally at the same level as the infeed and run-out tables. In this way, the washing racks to be cleaned can be easily and ergonomically pushed from the infeed table into the dishwasher and, after the end of the cleaning process, pushed out of the dishwasher onto the run-out table.

The expression "washing plane" used herein is to be understood to mean the horizontal plane in which the washing rack lies. In the treatment chamber of a dishwasher, the washing plane is generally defined by a guide system, in particular guide rails, by way of which an infeed table provided on the entrance side of the machine is received in the washing rack pushed through the treatment chamber.

Commercial batch dishwashers, in particular those in the form of hood-type dishwashers, are designed for cleaning large amounts of items of washware in as short a time as possible. In the case of hood-type dishwashers that are common nowadays, the duration of a preset standard programme, which is commonly used for normally soiled items of washware such as plates, bowls, cups and glasses, is only approximately 60 to 80 seconds. This yields a theoretical capacity of up to 45 to 60 racks per hour.

Depending on the items of washware and the level of soiling thereof, it may however be necessary to select a treatment programme with a longer duration in order to ensure a flawless cleaning result.

In this context, it is known from the prior art that commercial batch dishwashers have, for example, a special cutlery treatment programme (intensive treatment program) for improving the cleaning result specifically of cutlery. Such an intensive treatment programme lasts much longer than the abovementioned 60 to 80 seconds of the standard treatment program, for example approximately 360 seconds. It is thus clear that the capacity of the machine is greatly reduced if an intensive treatment programme is selected, because the treatment chamber is then occupied for much longer than would be the case with a standard treatment program.

In practice, this has the effect that special treatment programmes, which are normally provided as standard as an alternative to the standard treatment program, are generally, despite the improved washing performance, selected only seldomly by the operator of the dishwasher because the corresponding programme duration is considered to be too long, in particular in busy periods, that is to say during periods in which increased amounts of items of washware are encountered. Instead, it is often the case that the heavily soiled items of washware (in particular cutlery and GN containers) are likewise treated using the standard treatment program, and the low washing performance is compensated for by way of additional manual working steps, for example manual prewashing of heavily soiled GN containers, or separate pre-soaking of cutlery.

In the case of relatively heavily soiled items of washware, such as commonly the case, for example, with pots or pans, it is necessary in particular for the cycle length to be correspondingly increased in order to be able to achieve a flawless cleaning result. Normally, in the case of hood-type or pass-through dishwashers, the programme running time is lengthened to up to 10 minutes in order to be able to clean heavily soiled items of washware, in particular pots and pans with burnt-on food residues, in a hygienically flawless manner.

During said lengthened cycle times, the dishwasher consequently cannot be used for cleaning less heavily soiled items of washware, such as for example plates, cups, cutlery or glasses. In other words, for the cleaning of heavily soiled items of washware, in particular pans and pots, the dishwasher is blocked for a relatively long time, which in the case of relatively small sculleries, often leads to problems, because during this time, the soiled dishes that accumulate cannot be cleaned or processed further.

In practice, it is therefore the case in particular in busy periods that the dishwasher is used only for the cleaning of lightly soiled items of washware, such as for example plates, cups and glasses, whereas the heavily soiled washware (in particular pots and pans) are manually cleaned in order to prevent the dishwasher from becoming blocked for an excessively long time owing to the required longer cycle times.

SUMMARY

Accordingly, the present invention is based on the object of further developing a commercial utensil washer or dishwasher which is realized as a hood-type or pass-through dishwasher, such as is generally known in principle from the prior art, such that, even in busy periods in sculleries, no bottlenecks occur in the cleaning of the items of washware that accumulate. In particular, it is sought to specify a solution with which the working processes in sculleries can be simplified and optimized, while simultaneously saving resources (energy, water and chemicals).

It is a further object to further develop a commercial utensil washer or dishwasher, which is realized as a hood-type or pass-through dishwasher, such that the capacity of the machine can be improved, even if a treatment programme is selected which leads to a longer cycle time than would be the case with a conventional standard treatment program. In particular, it is the intention here to simultaneously save resources (energy, water and chemicals).

To achieve said object, there is proposed in particular a dishwasher in the form of a commercial utensil washer or dishwasher which is designed as a batch dishwasher, wherein the dishwasher is realized as a hood-type or pass-through dishwasher, and wherein the dishwasher has a treatment chamber with at least one wash system which is designed as a recirculation system. According to the invention, the treatment chamber has a first treatment zone and at least one further, second treatment zone, wherein items of washware can be treated independently of one another and at least temporarily at the same time in the first and in the at least one second treatment zone.

The expression "can be treated independently of one another" used herein is to be understood in particular to mean the treatment-zone-specific treatment of the items of washware with regard to action time, washing and/or rinsing mechanism, and/or with regard to the selected treatment program. In other words, according to the invention, provision is made for the treatment chamber to be divided into at least two zones, wherein at least some of the parameters that characterize the treatment of the items of washware (such as for example the action time, the washing/rinsing mechanism, the temperature and/or the composition of the wash liquid/final rinse liquid, etc.) can be set individually for each treatment zone.

In this context, it is conceivable for the two treatment zones to be designed to be physically, that is to say hermetically, separated from one another. This embodiment has the advantage in particular that different treatment programmes can be selected for the corresponding treatment zones of the treatment chamber. In this context, it is for example conceivable that, in one treatment zone, the items of washware are treated in accordance with a standard treatment program, whereas, in another treatment zone that is physically separate from the first treatment zone, the items of washware are treated in accordance with an intensive treatment program.

On the other hand, the present invention is not restricted to batch dishwashers in which the at least two treatment zones of the treatment chamber are physically (hermetically) separated from one another by way of a partition. According to a further aspect of the present invention, provision is rather made for the two treatment zones to be formed within a common treatment chamber, and in particular for no hermetic separation to be provided between the at least two treatment zones.

In the case of such embodiments, too, in which the at least two treatment zones are not hermetically separated from another, it is self-evidently also conceivable for the treatment of the items of washware to be performed with different action times in the different treatment zones. This is possible in particular even if one and the same treatment programme is selected for both treatment zones. In this context, it is for example conceivable that, in one of the two treatment zones, the items of washware remain in place for only one programme cycle, whereas, in the other treatment zone, the items of washware remain in place for more than one programme cycle, as a result of which the action time can be correspondingly multiplied.

In accordance with a preferred implementation of the solution according to the invention, provision is made for the at least two treatment zones to be arranged one above the other. In this context, it is expedient in particular for at least one of the at least two treatment zones, preferably each of the at least two treatment zones, to be designed to receive a washing rack, in which the items of washware for treatment in the respective treatment zone are received, in such a way that the lower region of the washing rack, on which the washing rack rests, is situated in a predefined or presettable horizontal washing plane.

In a preferred implementation of the dishwasher according to the invention, the first treatment zone can be closed by way of a vertically pivotable or slidable hood, and the at least one second treatment zone can be closed by way of a door formed separately from the hood. Here, provision is made in particular for the first and at least one second treatment zone to be arranged one above the other.

Here, it has proven to be advantageous for the first treatment zone to be formed as a main treatment zone and for the at least one second treatment zone to be formed as an auxiliary treatment zone. The dimensions and cleaning capacity of the main treatment zone (first treatment zone) and the dimensions and cleaning capacity of the auxiliary treatment zone (second treatment zone) are preferably adapted to the washware types (such as for example dishes, cutlery, glasses and pots) which are commonly encountered in sculleries and which are to be cleaned, to the quantities of items of washware to be cleaned, of each washware type, that are commonly encountered per unit of time, and/or to the level of soiling of the items of washware that are encountered per unit of time, in such a way that, during the operation of the dishwasher, all of the items of washware that accumulate can be cleaned as far as possible without delay, even during busy periods.

In this context, tests in various sculleries have shown that it is advantageous for the first treatment zone (main treatment zone) to have an effectively usable loading volume for the cleaning of items of washware which is 2 to 4 times greater than the effectively usable loading volume of the at least one second treatment zone. In particular, here, the first treatment zone is suitable for the cleaning of lightly soiled items of washware, which, in practice, are encountered in much greater quantities per unit of time than heavily soiled items of washware.

In a preferred implementation of the dishwasher, the effectively usable loading volume of the first treatment zone amounts to between 60 and 180 litres, and preferably between 80 and 150 litres, and is even more preferably approximately 120 litres. In this way, it is achieved that the cleaning capacity of the first treatment zone, that is to say the quantity of items of washware that can be cleaned per unit of time in the first treatment zone, corresponds to the cleaning capacity of a conventional hood-type or pass-through dishwasher such as is known from the prior art and which has only a single treatment zone.

With regard to the effectively usable loading volume of the at least one second treatment zone, it has proven to be advantageous for said loading volume to amount to between 25 and 75 litres and preferably between 30 and 50 litres. It is ensured in this way that, even during busy periods in sculleries, even relatively heavily soiled items of washware can be effectively cleaned in a short period of time.

In order that the dishwasher fits optimally into an established working process in a scullery, it is preferable for the footprint of the first treatment zone to have a dimension adapted to the footprint of a washing rack, and in particular a footprint of 600 mm×500 mm, 500 mm×500 mm or 400 mm×400 mm. Accordingly, the items of washware that have been loaded into washing racks can be treated in batchwise fashion in the first treatment zone.

In a preferred refinement of the dishwasher according to the invention, the first treatment zone can be closed by way of a vertically pivotable or slidable hood, wherein the hood is designed such that it can be pivoted or slid vertically upward by at least 300 mm, preferably by at least 400 mm. In this way, an adequately large entrance height is ensured, such that even relatively large items of washware, such as for example trays, can be easily introduced into and removed from the first treatment zone. In this context, it is furthermore advantageous if the first treatment zone has an effective height of at least 400 mm for the cleaning of items of washware.

With regard to the internal dimensions of the at least one second treatment zone, it is advantageous for said at least one second treatment zone to be adapted to the dimensions of commonly used pans and/or pots, because this washware type is generally the most heavily soiled. In accordance with one implementation of the dishwasher according to the invention, the at least one second treatment zone has, for this purpose, an effective height of at least 120 mm, and preferably of at least 150 mm, for the cleaning of items of washware.

In order that the dishwasher according to the invention can be used without problems even in relatively small sculleries, the dishwasher has, in the closed state of the treatment zones, a width of between 500 mm and 800 mm, and preferably of between 600 mm and 800 mm, a depth of between 700 mm and 900 mm, and preferably of between 750 mm and 850 mm, and a height of between 1350 mm and 1600 mm, and preferably of between 1400 mm and 1550 mm.

According to a further aspect of the present invention, the dishwasher has a wash system, which is designed as a recirculation system, for spraying wash liquid in the treatment chamber as required, and has at least one final rinse system for spraying final rinse liquid in the treatment chamber as required. Furthermore, a control device is provided for the control of the at least one wash system and/or of the at least one final rinse system. Here, the control device is preferably designed to control the at least one wash system such that the wash cycle of each treatment cycle in the first treatment zone is uninterrupted in terms of time, whereas the wash cycle of a single treatment cycle in the at least one second treatment zone is intermittent. In this way, even using only a single wash pump and without the use of a valve controller, it is possible for the action times of the wash liquid in the individual treatment zones to be set to any desired values in each case.

In a refinement of the latter embodiment, it is provided in this context that the control device is furthermore designed to control the at least one wash system such that wash liquid is always sprayed simultaneously in the first and in the at least one second treatment zone.

With regard to the at least one final rinse system, provision is preferably made whereby the control device is designed to control the at least one final rinse system such that a final rinse cycle in the at least one second treatment zone always takes place simultaneously, or at least with a time overlap, with respect to a final rinse cycle in the first treatment zone. In this way, the risk of recontamination of the items of washware is minimized, which applies in particular to embodiments in which the treatment zones are not hermetically separated from one another.

In order to achieve that the dishwasher operates as efficiently as possible in terms of time, provision is made, in a preferred implementation of the dishwasher, whereby the treatment cycles in the first and in the at least one second treatment zone are adapted to one another in terms of time. For this purpose, it is conceivable, by way of the control device, for the at least one wash system to be controlled such that the time duration of a wash cycle of a single treatment cycle in the at least one second treatment zone corresponds to the total time duration of the wash cycles of a multiplicity of treatment cycles in the first treatment zone.

The expression "treatment cycle" used herein is to be understood to mean the cycle to which the respective items of washware in the corresponding treatment zone of the dishwasher are subjected before the items of washware are can be removed from the treatment zone again in the cleaned state. Normally, therefore, a treatment cycle is made up of a wash cycle and of a subsequent final rinse cycle. During a wash cycle, wash liquid is sprayed onto the items of washware, wherein, during a final rinse cycle, final rinse liquid is sprayed onto the items of washware.

Alternatively or in addition to the latter embodiment, it is conceivable, by way of the control device, for the at least one wash system to be controlled such that the time duration of a wash cycle of a single treatment cycle in the at least one second treatment zone is an integer multiple of the time duration of a wash cycle in the first treatment zone.

In a preferred refinement of the dishwasher according to the invention, the control device is furthermore designed to control the at least one wash system and/or the at least one final rinse system such that a wash cycle in the at least one second treatment zone is automatically, preferably selectively automatically, interrupted if at least one of the following conditions is met:

- a final rinse cycle is taking place in the first treatment zone; and/or
- the first treatment zone is opened or is not closed; and/or
- the second treatment zone is opened or is not closed.

In this way, the respective final rinse cycle of the individual treatment zones can be optimally adapted, which saves resources, in particular fresh water and energy.

In a refinement of the invention, to be able to achieve the most efficient possible treatment of the items of washware in the treatment zones, provision is made whereby, for the treatment zones, the treatment parameters are selected as far as possible individually and in a manner adapted to the items of washware to be cleaned.

In this context, it is conceivable for the at least one wash system to be controlled such that, during a wash cycle:

- the temperature of the wash liquid that is sprayed in the first treatment zone differs from the temperature of that in the at least one second treatment zone; and/or
- the nozzle pressure of the wash liquid that is sprayed in the first treatment zone differs from the nozzle pressure of the wash liquid that is sprayed in the at least one second treatment zone; and/or
- the amount of wash liquid that is sprayed in the first treatment zone per unit of time differs from the amount of wash liquid that is sprayed in the at least one second treatment zone per unit of time; and/or
- the detergent concentration in the wash liquid that is sprayed in the first treatment zone differs from the detergent concentration in the wash liquid that is sprayed in the at least one second treatment zone.

Alternatively or in addition to this, it is conceivable that, by way of the control device, the at least one final rinse system is controlled such that, during a final rinse cycle:

- the temperature of the final rinse liquid that is sprayed in the first treatment zone differs from the temperature of the final rinse liquid that is sprayed in the at least one second treatment zone; and/or
- the nozzle pressure of the final rinse liquid that is sprayed in the first treatment zone differs from the nozzle pressure of the final rinse liquid that is sprayed in the at least one second treatment zone; and/or
- the amount of final rinse liquid that is sprayed in the first treatment zone per unit of time differs from the amount of final rinse liquid that is sprayed in the at least one second treatment zone per unit of time; and/or
- the final rinse agent concentration in the final rinse liquid that is sprayed in the first treatment zone differs from the final rinse agent concentration in the final rinse liquid that is sprayed in the at least one second treatment zone.

The invention is directed not only to an in particular hood-type or pass-through dishwasher in which at least two treatment zones are provided in the treatment chamber of the dishwasher but also to a corresponding method for operating a dishwasher of said type.

According to the invention, the method has the following method steps:

- in the first treatment zone and in the at least one second treatment zone, wash liquid is sprayed simultaneously until the wash cycle in the first treatment zone has come to an end;
- after the end of the wash cycle in the first treatment zone, the wash cycle of the at least one second treatment zone is interrupted and final rinse liquid is sprayed in the first treatment zone; and
- the spraying of wash liquid in the at least one second treatment zone is resumed only when a further wash cycle is commenced in the first treatment zone.

According to a further aspect of the present invention, to carry out the method according to the invention, the dishwasher has a control device for controlling the at least one wash system of the dishwasher in accordance with a preset programme sequence, wherein, in the control device, there is stored at least one preset programme sequence for the first treatment zone and/or the at least one second treatment zone. In particular, in the control device, there is stored a multiplicity of preset programme sequences for the first treatment zone and/or the at least one second treatment zone, in order to enable the operator to select the most suitable treatment parameters possible.

To reduce the operating effort in the programme selection process, provision is made, in a preferred refinement of the latter embodiments, that, in the control device, there is stored at least one programme sequence group with a fixed programme sequence for the first treatment zone and a fixed programme sequence for the at least one second treatment zone.

In this context, it is conceivable in particular that the operator can optionally select one programme sequence from the multiplicity of preset programme sequences for the first treatment zone and, independently of this, can select one programme sequence from the multiplicity of preset programme sequences for the at least one second treatment zone, or can select a preset programme sequence group.

The programme sequences of the programme sequence group are preferably selected in a manner dependent on at least one of the following factors:

- a quantity of items of washware that is primarily encountered, per unit of time, in a standard situation; and/or
- the different types of items of washware that are primarily encountered, per unit of time, in a standard situation; and/or
- a level of soiling of the items of washware that is primarily encountered in a standard situation.

In a preferred implementation of the latter embodiments, provision is made whereby the programme sequence group has, for the first treatment zone, a programme sequence in which the time duration for a wash cycle of the first treatment zone amounts to 40 to 70 seconds (short program), 70 to 120 seconds (standard program) or 2 to 5 minutes (intensive program). With regard to the programme sequence for the at least one second treatment zone, provision is made here whereby, in accordance with this programme sequence, the time duration for a wash cycle in the at least one second treatment zone is identical to the time duration for a wash cycle in the first treatment zone.

Alternatively or in addition to this, it is conceivable for the programme sequence group to have, for the at least one second treatment zone, a programme sequence in which the time duration for a wash cycle in the at least one second treatment zone amounts to 40 to 70 seconds (short program), 70 to 120 seconds (standard program) or 4 to 10 minutes (intensive program).

According to a further aspect of the present invention, provision is made whereby the dishwasher has at least one user interface with at least one in particular manually or optically actuable input panel for the manual selection of at least one treatment programme for the first and/or at least one second treatment zone.

An "manually actuable input panel" is to be understood in particular to be a keyboard or the like, whereas an "optically actuable input panel" is an input panel which can be actuated by radio, IR, WLAN or a similar wireless communication connection.

Here, in accordance with a preferred implementation, provision is made whereby a common user interface is provided for the first and at least one second treatment zone. Said common user interface is preferably arranged in the upper region of the vertical pivotable or slidable hood by way of which the first treatment zone can be closed. In this way, it is ensured that the operator of the machine can manually actuate the input panel only when the first treatment zone is closed.

As an alternative to this, it is however self-evidently also conceivable for in each case one user interface to be provided for the first and at least one second treatment zone.

In a preferred implementation of the invention, provision is made whereby the at least one user interface is designed for outputting, preferably by optical and/or acoustic means, information regarding a system state of the dishwasher.

Alternatively or in addition, it is conceivable for the at least one user interface to have at least one in particular optical or manually actuable input panel, in particular keyboard, for manual intervention into a treatment cycle of the first treatment zone and/or into a treatment cycle of the at least one second treatment zone.

In this context, it is furthermore conceivable for the at least one user interface to have a first manually actuable input panel, in particular keyboard, for starting and/or ending a treatment cycle in the first and/or at least one second treatment zone, and a second, in particular manually or optically actuable input panel which is formed separately from the first input panel and which serves for the accessing of information relating to a system state of the dishwasher and/or for manual intervention into a treatment cycle of the first and/or at least one second treatment zone and/or for the accessing and/or selection of programme parameters for the first and/or at least one second treatment zone.

In a particularly preferred embodiment of the dishwasher according to the invention, the first and the at least one second treatment zone are physically separated from one another by means of a partition in such a way that, when wash liquid is sprayed in one of the two treatment zones, recontamination in the other treatment zone which is caused in particular by said spraying operation is effectively prevented.

Here, it is preferably the case that the wash system of the dishwasher is assigned to the first and to the at least one second treatment zone. The wash system has a wash pump system and a wash nozzle system, wherein the wash pump system, at the intake side, forms a flow connection or can form a flow connection with the wash tank for the purposes of supplying liquid which has collected in the wash tank to the wash nozzle system as required.

Here, in a preferred implementation of the dishwasher, the wash nozzle system has a large number of wash nozzles which are associated with the first treatment zone and has a large number of wash nozzles which are associated with the second treatment zone, wherein, when the wash pump system is operated, the liquid which has collected in the wash tank is supplied as wash liquid both to the wash nozzles which are associated with the first treatment zone and also to the wash nozzles which are associated with the second treatment zone.

Here, provision is made in particular for at least some of the wash nozzles, in particular at least some of the wash nozzles which are associated with the at least one second treatment zone, to be designed as wash nozzles which are stationary in relation to the corresponding treatment zone.

According to a further aspect of the invention, it is provided here that at least some of the stationary wash nozzles are formed in the partition and/or in at least one wash arm which is stationary in relation to the corresponding treatment zone.

For example, the partition may have a partition element, in particular a partition plate, which runs substantially horizontally and is arranged or can be arranged between the first and the at least one second treatment zone, and also has a line system which is arranged on the partition element, wherein the line system which is arranged on the partition element forms a flow connection or can form a flow connection with the wash pump system, and wherein at least some of the wash nozzles, which are stationary in the partition, are realized in the line system which is arranged on the partition element or form a flow connection at least with the line system which is arranged on the partition element.

In a preferred implementation of the dishwasher according to the invention, the wash nozzles which are associated with the at least one second treatment zone are formed in an upper wash arm system which is arranged in an upper region of the at least one second treatment zone and in a lower wash arm system which is arranged in the lower region of the at least one second treatment zone, wherein the upper and/or the lower wash arm system are/is stationary in relation to the at least one second treatment zone.

Provision is particularly preferably made whereby a dedicated final rinse system with in each case a final rinse pump and final rinse nozzles is associated with each treatment zone of the dishwasher.

Here, it is preferably the case that at least some of the final rinse nozzles, in particular at least some of the final rinse nozzles which are associated with the at least one second treatment zone, are designed as final rinse nozzles which are stationary in relation to the corresponding treatment zone.

In particular, it is preferable if at least some of the stationary final rinse nozzles are formed in the partition and/or in at least one final rinse arm which is stationary in relation to the corresponding treatment zone.

In a particularly preferred implementation of the dishwasher according to the invention, the partition has a partition element, in particular partition plate, which runs substantially horizontally and is arranged or can be arranged between the first and the at least one second treatment zone, and also has a line system which is arranged on the partition element, wherein the line system which is arranged on the partition element forms a flow connection or can form a flow connection with the final rinse pump which is associated with the second treatment zone, and wherein at least some of the final rinse nozzles, which are stationary in the partition, are realized in the line system which is arranged on the partition element or form a flow connection at least with the line system which is arranged on the partition element.

BRIEF DESCRIPTION OF THE DRAWINGS

Below, the invention will be described in more detail with reference to the exemplary embodiments illustrated in the drawings, in which.

DETAILED DESCRIPTION

The invention relates to commercial dishwashers, in particular dishwashers or utensil washers, in the form of batch dishwashers. In particular, the present invention relates to batch dishwashers designed as hood-type or (rack-type) pass-through dishwashers.

A commercial dishwasher 1 designed as a batch dishwasher has, as is conventional, a programme control device (also referred to here as "control device 100") for the control of at least one cleaning program, and has a treatment chamber 2, which can be closed by way of at least one door 9 and/or at least one hood 8, in a machine housing for receiving items of washware to be cleaned, such as for example dishes, cutlery, pots, pans, trays and glasses.

Figure 2:
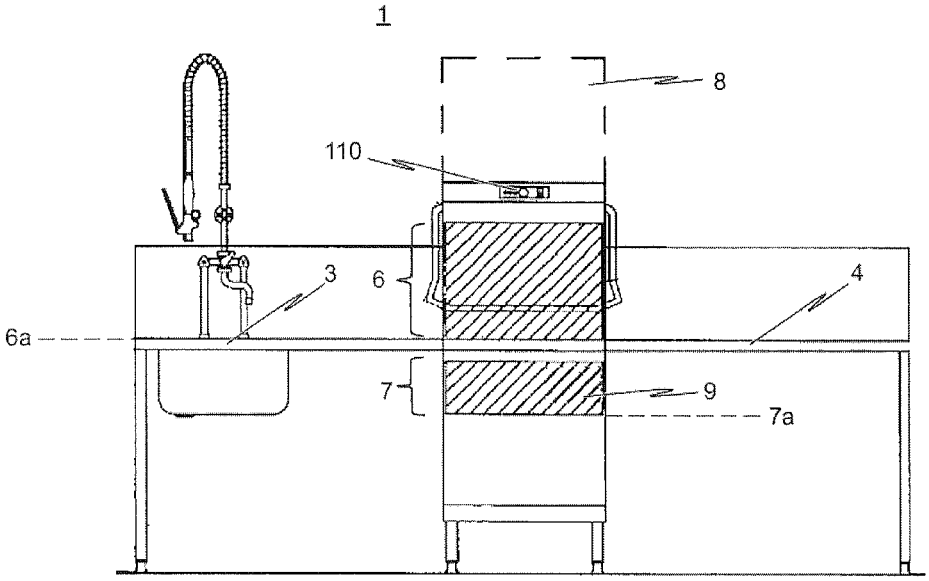
FIG. 2 schematically shows a batch dishwasher, designed as a hood-type dishwasher, according to a further embodiment of the invention.
Figure 3:
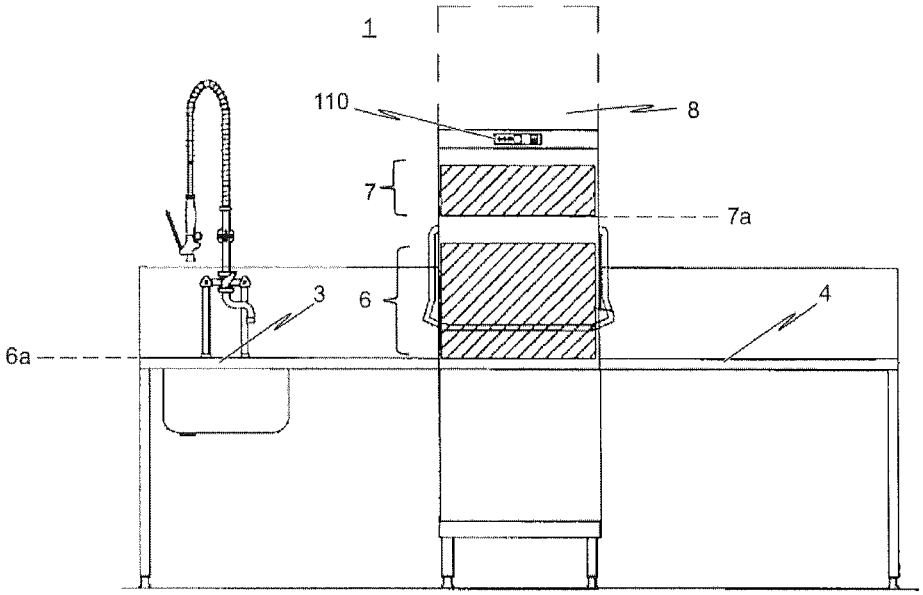
FIG. 3 schematically shows a batch dishwasher, designed as a hood-type dishwasher, according to a further embodiment of the invention.

As can be seen in particular from the illustrations in FIGS. 2 and 3, it is advantageous from an ergonomic aspect if a batch dishwasher designed as a pass-through dishwasher 1 is, at its infeed and run-out sides, equipped with in each case one table (infeed table 3, run-out table 4). The racks 5 laden with soiled items of washware can thus be pushed into the dishwasher 1 on the infeed table 3. After the treatment of the items of washware in the treatment chamber 2 of the dishwasher 1, the rack 5 with the then cleaned items of washware is moved out of the machine 1 onto the run-out table 4.

The action time, that is to say the time during which the cleaning or wash liquid wets the items of washware within the treatment chamber 2 is dependent in particular on the duration of the wash phase defined by way of the treatment program. For normally soiled items of washware, such as plates, bowls, cups and/or glasses, a cleaning cycle composed of a wash phase and of a subsequent final rinse phase generally requires between 50 and 100 seconds. However, longer treatment of the items of washware may be necessary, in particular if these are relatively heavily soiled, or if dirt has burned onto the items of washware. Lengthening of the overall treatment time to up to 400 seconds is then often necessary. As a result of the lengthened action time, the items of washware to be cleaned are subjected to intensive treatment, such that even relatively heavily soiled items of washware can be effectively cleaned.

To ensure that, despite an intensive treatment, the cleaning capacity of the dishwasher 1, that is to say the items of washware/washware racks 5 that can theoretically be processed by the machine 1 per unit of time, is not adversely affected, provision is made, according to the invention, for the treatment chamber 2 of the dishwasher 1, which is designed as a batch dishwasher, to be divided into at least two treatment zones 6, 7, wherein the at least two treatment zones 6, 7 are designed such that the treatment of the items of washware in the individual treatment zones 6, 7 can be performed independently of one another.

Even though the exemplary embodiments of the dishwasher 1 according to the invention illustrated in the drawings are each formed with precisely two treatment zones 6, 7, this is not to be regarded as being restrictive. Rather, it is self-evidently also conceivable for the treatment chamber 2 of the dishwasher 1 according to the invention to be divided into more than two zones.

As illustrated by way of example in FIGS. 1A and 1B, an exemplary embodiment of the present invention relates to a (rack-type) pass-through dishwasher 1 which is designed as a hood-type dishwasher 1 and which is distinguished in particular by the fact that, in addition to the (main) treatment zone 6 that is provided in the conventional manner, a further treatment zone 7 is formed, which is arranged below the former treatment zone 6. The upper, main treatment zone 6, which is herein also referred to as "first treatment zone", is designed to receive a washing rack 5 which is possibly laden with the items of washware to be treated.

For this purpose, the footprint of the first treatment zone or main treatment zone 6 has dimensions adapted to the footprint of a washing rack 5, and in particular a footprint of 600 mm×500 mm, 500 mm×500 mm, or 400 mm×400 mm.

Furthermore, the main treatment zone 6 is designed such that the washing rack 5 can be pushed from an infeed table 3 (not illustrated in FIGS. 1A and 1B) directly into the treatment zone 6 of the hood-type dishwasher 1. In other words, the washing plane 6*a* of the main treatment zone 6 is aligned, in a horizontal direction, with the table height of the infeed table 3.

Figure 1A:
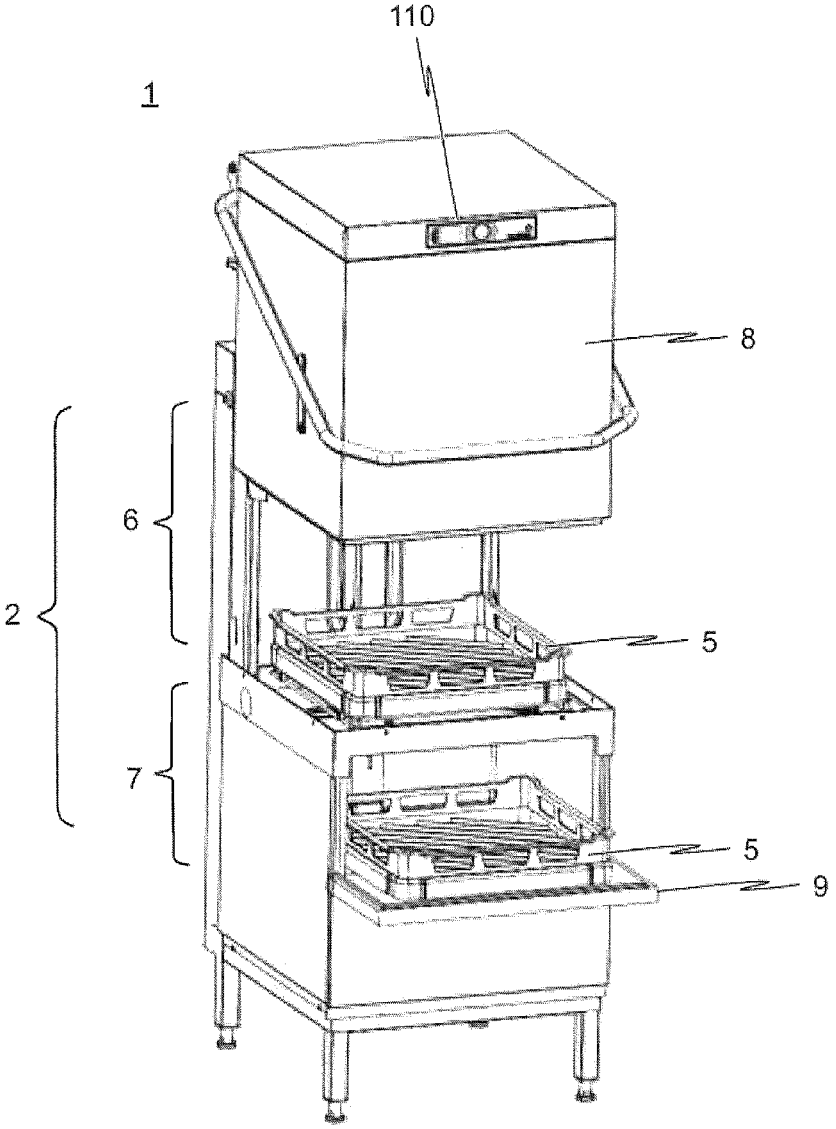
FIG. 1A shows a batch dishwasher, designed as a hood-type dishwasher, according to an embodiment of the present invention in a perspective view.
Figure 1B:
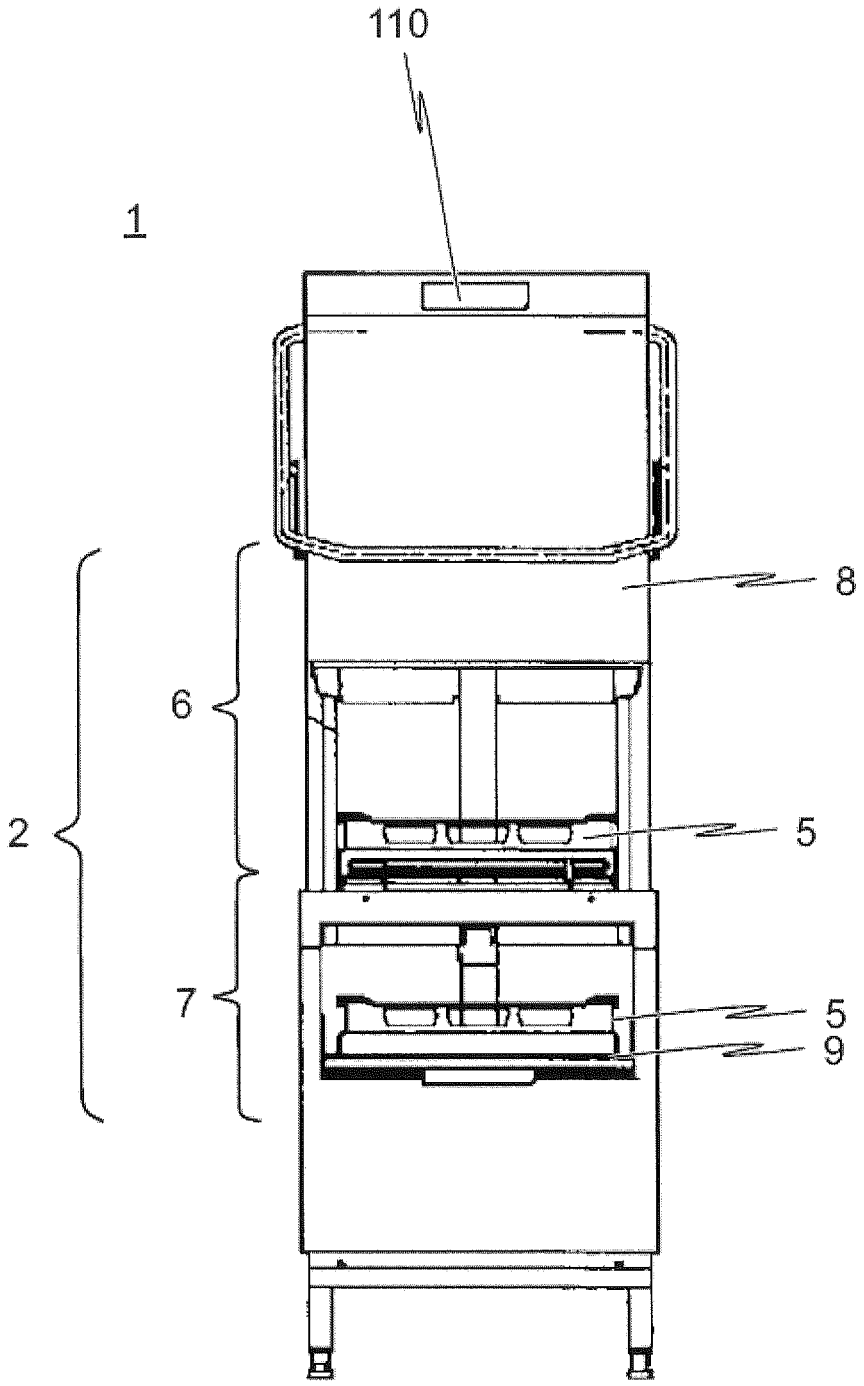
FIG. 1B shows the embodiment shown in FIG. 1A in a front view.

In particular, in the case of the dishwasher 1 shown in FIG. 1B, the height of the horizontal washing plane 6*a* of the first treatment zone 6 is variably adjustable, and amounts to preferably 800 mm to 900 mm, and preferably 830 mm to 890 mm. The adjustment of the height of the horizontal washing plane 6*a* of the first treatment zone 6 is realized for example by way of height-adjustable feet of the machine.

It is preferable if, furthermore, a run-out table 4 is provided, wherein the table height of the run-out table 4 is likewise aligned horizontally with the washing plane 6*a* of the main treatment zone 6, such that the washing rack 5 can, after the treatment in the main treatment zone 6, be pushed directly onto the run-out table 4.

As already indicated, a further treatment zone 7 is formed below the main treatment zone 6. Said further treatment zone 7, which will hereinafter also be referred to as "second treatment zone" or "auxiliary treatment zone", serves in particular for the cleaning of items of washware which require a relatively long action time in relation to the items of washware to be cleaned in the first treatment zone 6.

In the case of the exemplary embodiment illustrated in FIGS. 1A and 1B, the second treatment zone 7 is likewise designed to receive a washing rack 5, wherein the items of washware to be treated in the further treatment zone 7 are received in the washing rack 5.

Specifically, the dimensions and cleaning capacity of the main treatment zone (first treatment zone 6) and the dimensions and cleaning capacity of the auxiliary treatment zone (second treatment zone 7) are preferably adapted to the washware types (such as for example dishes, cutlery, glasses and pots) which are commonly encountered in sculleries and which are to be cleaned, to the quantities of items of washware to be cleaned, of each washware type, that are commonly encountered per unit of time, and/or to the level of soiling of the items of washware that are encountered per unit of time, in such a way that, during the operation of the dishwasher 1, all of the items of washware that accumulate can be cleaned as far as possible without delay, even during busy periods.

Therefore, in the embodiment of the dishwasher 1 according to the invention shown in FIG. 1B, provision is made whereby the first treatment zone 6 has an effectively usable loading volume for the cleaning of items of washware which is 2 to 4 times greater than the effectively usable loading volume of the second treatment zone 7. Specifically, here, the effectively usable loading volume of the first treatment zone 6 amounts to between 60 and 180 litres, and preferably between 80 and 150 litres, and is even more preferably approximately 120 litres, whereas the effectively usable loading volume of the second treatment zone 7 amounts to a loading volume of between 25 and 75 litres and preferably between 30 and 50 litres. It is ensured in this way that, even during busy periods in sculleries, even relatively heavily soiled items of washware can be effectively cleaned in a short period of time.

As illustrated, in the exemplary embodiment of the invention schematically illustrated in FIGS. 1A and 1B, provision is made whereby the two treatment zones 6, 7 can be loaded with items of washware, and unloaded, independently of one another. Specifically, the first treatment zone 6 can be loaded with items of washware, and unloaded, via an opening that can be closed off by way of a hood 8 which is slidable in a vertical direction. The sliding travel of the hood 8 amounts to at least 300 mm, preferably at least 400 mm, whereas the first treatment zone 6 has an effective height of at least 400 mm for the cleaning of items of washware.

On the hand, the second treatment zone 7 has an effective height of at least 120 mm, and preferably of at least 150 mm, for the cleaning of items of washware, such that cutlery that is received in cutlery racks can also be cleaned in said treatment zone 7.

In addition to this, the second treatment zone 7 has a dedicated closable opening by which said treatment zone 7 can be loaded with items of washware and unloaded.

In the case of the exemplary embodiment illustrated in FIGS. 1A and 1B, provision is made in particular whereby the second treatment zone 7 has a dedicated opening which can be closed off by way of a door 9 which is pivotable about a horizontal pivot axis, via which opening the second treatment zone 7 can be loaded with items of washware and unloaded.

Here, it is advantageous in particular for the door 9, which is pivotable about a horizontal pivot axis, to be designed such that, in its open state, it is aligned horizontally with the washing plane 7*a* of the further treatment zone 7. In this way, in its open state, the door 9 simultaneously serves as a loading and unloading aid for the pushing-in or pushing-out of the items of washware or of the washing rack 5.

In the same way as the height of the horizontal washing plane 6*a* of the first treatment zone 6, the height of the horizontal washing plane 7*a* of the second treatment zone 7 is also variably adjustable, and amounts to preferably 350 mm to 600 mm, and even more preferably 500 mm to 600 mm (measured from the ground of the installation room).

FIG. 2 shows the exemplary embodiment of the dishwasher 1 according to the invention as per FIGS. 1A and 1B in a configuration in which the dishwasher 1 is equipped with infeed and run-out tables 3, 4. Specifically, on the infeed side of the dishwasher 1, it is normally the case that manual clearing and manual pre-washing of the soiled items of washware are performed. Furthermore, here, the soiled items of washware can be loaded into special washing racks 5.

The run-out side serves for the drying and unloading of the washing racks. As illustrated in FIG. 2, the washing plane 6*a* of the main treatment zone 6 is situated at the same height as the infeed and run-out tables 3, 4. In this way, the washing racks 5 to be cleaned can be easily and ergonomically pushed from the infeed table 3 into the main treatment zone 6 of the hood-type dishwasher 1 and, after the end of the cleaning process, pushed out of the dishwasher 1 onto the run-out table 4.

As can be seen in particular from the schematic illustration in FIG. 3, the present invention is not restricted to an arrangement of the additional treatment zone 7 below the main treatment zone 6. Rather, it is self-evidently also conceivable for the additional treatment zone 7 to be arranged adjacent to the main treatment zone 6 or above the main treatment zone 6.

With regard to the embodiments of the dishwasher 1 according to the invention shown in FIGS. 1 to 3, it should be noted that, in the closed state of the treatment zones 6, 7, said dishwasher has a width of between 500 mm and 800 mm, and preferably of between 600 mm and 800 mm, a depth of between 700 mm and 900 mm, and preferably of between 750 mm and 850 mm, and a height of between 1350 mm and 1600 mm, and preferably of between 1400 mm and 1550 mm. In other words, the external dimensions of the dishwasher 1 according to the invention are similar to those of a conventional machine of similar type which has only a single treatment zone, wherein, however, with the dishwasher according to the invention, the machine capacity is increased, with relatively reduced consumption of resources.

In order, for example, to clean the items of washware that accumulate in the case of a total of 150 menu options, a conventional dishwasher which has only a single treatment zone requires a total of 67 minutes, with fresh water consumption of 100 litres and energy consumption of 2.9 kWh (in the case of a standard treatment program).

By contrast, with the dishwasher 1 according to the invention, the treatment duration can be reduced to below 50 minutes, specifically with fresh water consumption of 72.5 litres and energy consumption of 2.1 kWh.

Below, with reference to the illustrations in FIGS. 4 to 6, a description will be given of the functioning of different wash/final rinse systems that are used for example in a dishwasher 1, designed as a batch dishwasher, according to the present invention.

Although it is basically conceivable for the dishwasher 1 according to the present invention to be equipped with multiple wash tanks, wherein in each case one wash tank is assigned to one treatment zone 6, 7, provision is made, in the preferred exemplary embodiments of the solution according to the invention illustrated in the drawings, whereby the dishwasher 1 has in each case only a single wash tank 12 which is assigned to the (single) treatment chamber 2 and which is thus assigned jointly to the individual treatment zones 6, 7 of the (single) treatment chamber 2.

The wash tank 12 preferably has a capacity of 20 to 40 litres, preferably 25 to 35 litres. This capacity is firstly sufficient for simultaneous final rinse operation in both treatment zones 6, 7. Secondly, the tank 12 is selected to be so small that it can, as before, be accommodated in the reduced installation space—in relation to a conventional machine which has only a single treatment zone—in the machine housing.

As illustrated in the hydraulic diagrams in FIGS. 4 to 6, the (single) wash tank 12 is situated below the treatment chamber 2 of the machine 1 and serves for receiving liquid that has been sprayed in the respective treatment zones 6, 7 of the treatment chamber 2. As already indicated, in the embodiments illustrated in the drawings, provision is made whereby the treatment chamber 2 of the dishwasher 1 is divided into a total of two treatment zones 6, 7, specifically a main treatment zone 6 and an auxiliary treatment zone 7. The treatment zones 6, 7, which are integrated within the (single) treatment chamber 2, are assigned a common wash system.

Figure 4:
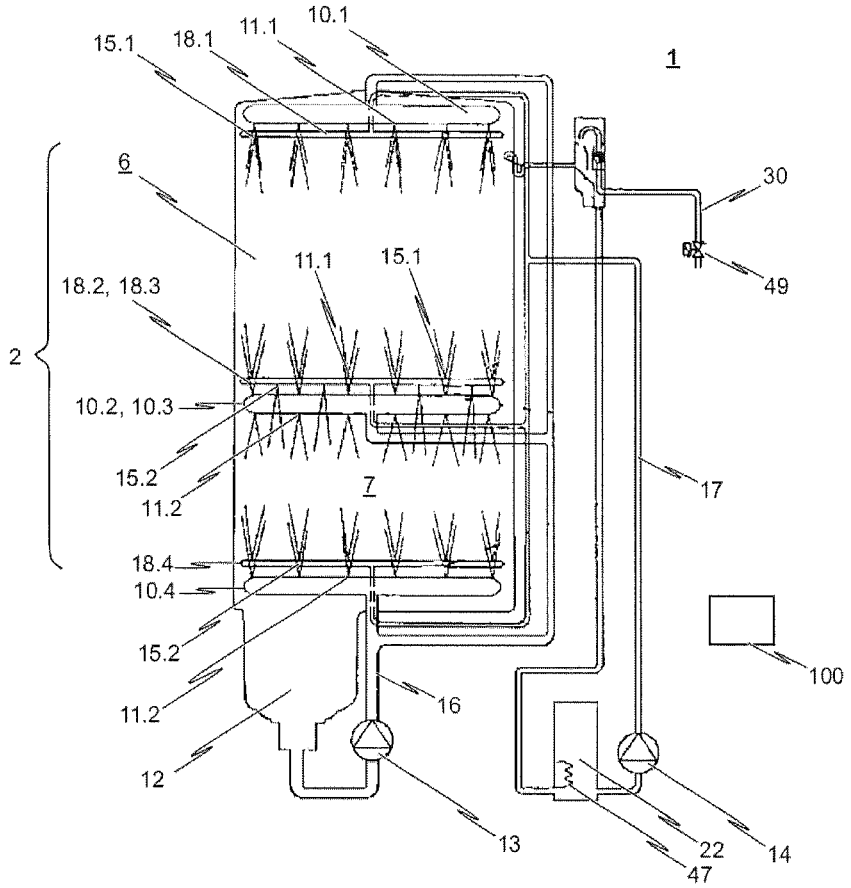
FIG. 4 schematically shows a hydraulic diagram of a wash system of a dishwasher, designed as a batch dishwasher, according to an embodiment of the present invention.

In the hydraulic diagram illustrated in FIG. 4, the wash system has a (common) wash pump 13 by way of which wash liquid can be delivered from the wash tank 12 through a wash liquid line system to corresponding wash nozzles 11.1, 11.2.

In the embodiment schematically illustrated in FIG. 4, the wash nozzles 11.1, 11.2 are integrated into corresponding wash arms 10.1, 10.2, 10.3. Here, provision is made whereby the upper (main) treatment zone 6 is assigned a first nozzle arrangement composed of an upper wash arm 10.1 and a lower wash arm 10.2. The lower (auxiliary) treatment zone 7 is assigned a further nozzle arrangement, which likewise has an upper wash arm 10.3 and a lower wash arm 10.4.

In the hydraulic diagram shown in FIG. 4, the lower wash arm 10.2 of the main treatment zone 6 and the upper wash arm 10.3 of the auxiliary treatment zone 7 are designed as a common wash arm. In other words, in this exemplary embodiment, use is made of a single wash arm 10.2, 10.3 which performs a dual function: said common wash arm serves as a lower wash arm of the (upper) main treatment zone 6 and, at the same time, as an upper wash arm of the (lower) auxiliary treatment zone 7. For this purpose, the common wash arm has wash nozzles 11.1 oriented in the direction of the (upper) main treatment zone 6 and wash nozzles 11.2 oriented in the direction of the (lower) auxiliary treatment zone 7.

The present invention is self-evidently not restricted to this aspect. As can be seen from the hydraulic diagram as per FIG. 5, it is also conceivable for no common wash arm to be used, such that each individual treatment zone 6, 7 is assigned separate wash arms 10.1-10.4.

The wash nozzles 11.1, 11.2 integrated into the corresponding wash arms 10.1-10.4 are directed in each case toward the correspondingly associated treatment zone 6, 7 in the treatment chamber 2 and serve to spray the wash liquid, which is delivered by the common wash pump 13, onto the items of washware which are arranged in the respective treatment zones 6, 7 and which are to be cleaned.

The sprayed wash liquid falls back into the wash tank 12 under the action of gravitational force. In this way, the wash tank 12, the wash pump 13, the wash liquid system 16 and the wash nozzles 11, together with the treatment zones 6, 7 of the treatment chamber 2, form a wash liquid circuit. The wash liquid line system 16 connects the pressure side of the wash pump 13 to the wash nozzles 11.1, 11.2.

Furthermore, a final rinse system is provided for the delivery of final rinse liquid by way of a final rinse pump 14 through a final rinse line system 17 to final rinse nozzles 15*a*, 15*b*, which final rinse nozzles are directed, in the treatment chamber 2, toward the region of the items of washware to be cleaned. The sprayed final rinse liquid falls from the treatment chamber 2 into the wash tank 12 under the action of gravitational force. The final rinse system 17 connects the pressure side of the final rinse pump 14 to the final rinse nozzles 15.1, 15.2.

As already stated, the wash nozzles 11.1, 11.2 and the final rinse nozzles 15.1, 15.2 may be arranged in the regions above and/or below, and if desired also to the sides, of the respective treatment zone 6, 7 within the treatment chamber 2, and may in each case be directed toward the region in which the items of washware are positioned in the corresponding treatment zone.

It is preferably the case that, for each treatment zone 6, 7, a large number of wash nozzles 11.1 and 11.2 are provided on at least one upper wash arm 10.1 and 10.3 respectively, a large number of wash nozzles 11.1 and 11.2 are provided on a lower wash arm 10.2 and 10.4 respectively, a large number of final rinse nozzles 15.1 and 15.2 are provided on at least one upper final rinse arm 18.1 and 18.3 respectively, and a large number of final rinse nozzles 15.1 and 15.2 are provided on at least one lower final rinse arm 18.2 and 18.4 respectively. As already stated, it is possible here for the lower wash arm 10.2 of the upper, main treatment zone 6 and the upper wash arm 10.3 of the lower, auxiliary treatment zone 7 to be formed as a common wash arm (cf. FIG. 4). The same also applies to the corresponding final rinse arms 18.2, 18.3.

Figure 5:
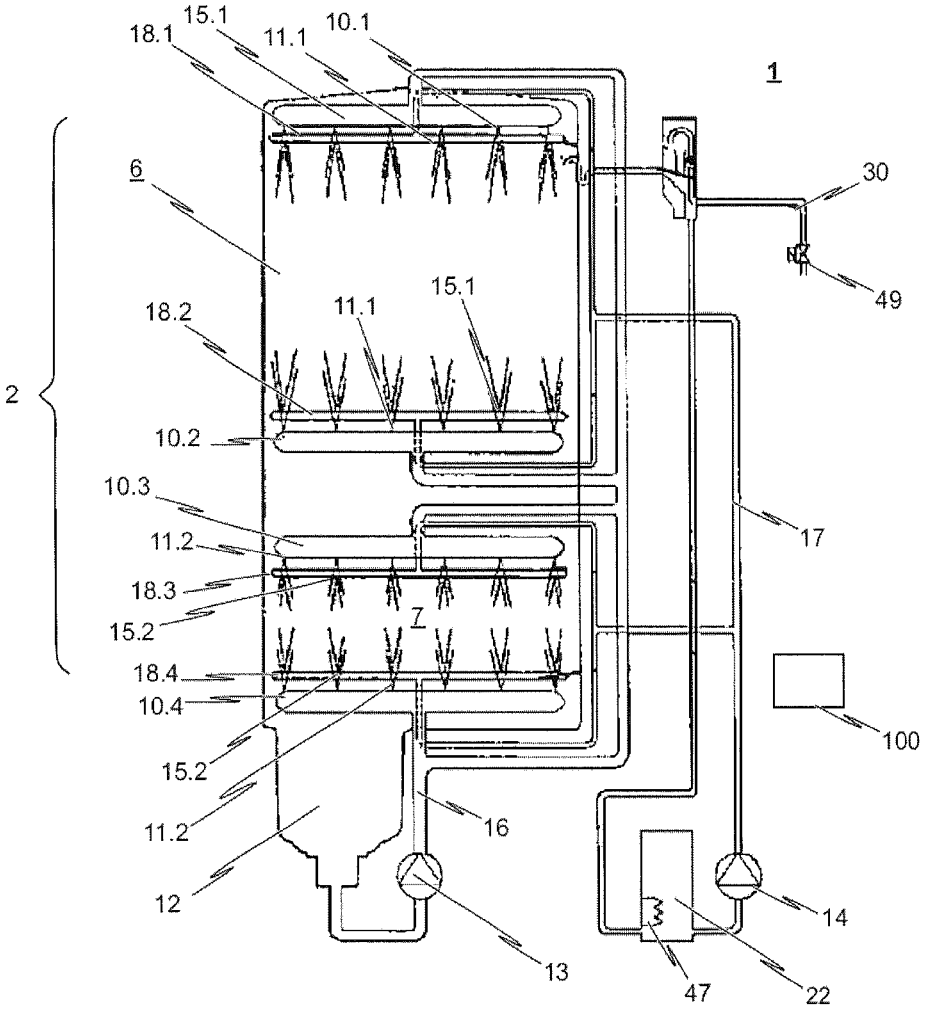
FIG. 5 schematically shows a hydraulic diagram of a wash system of a dishwasher, designed as a batch dishwasher, according to a further embodiment of the present invention.

As an alternative to this, it is nevertheless conceivable for separate wash or final rinse arms 10.1-10.4 and 18.1-18.4, respectively, to be provided for each of the at least two treatment zones 6, 7, as indicated in the hydraulic diagram in FIG. 5.

Before final rinse liquid is sprayed during the final rinse phase, an amount of wash liquid equivalent to the final rinse liquid amount is in each case pumped out of the wash tank 12 by way of a discharge pump (not illustrated in the drawings), the suction side of which is connected via a discharge line to a sump of the wash tank 12. If, before an initial start of the dishwasher 1 which is designed as a batch dishwasher, the wash tank 12 is empty, it must firstly be filled with fresh water via a fresh water line (not shown), or filled with fresh water, or some other final rinse liquid or wash liquid, by way of the final rinse system and the final rinse pump 14 thereof.

The final rinse liquid may be fresh water or fresh water mixed with final rinse agent. By contrast, the wash liquid comprises detergent which is dosed preferably automatically to the liquid contained in the wash tank 12 by a detergent dosing device (not shown). The abovementioned programme control device controls the wash pumps 13, the final rinse pump 14, the drainage pump and the detergent solution pump (not shown) in a manner dependent on the cleaning programme respectively selected by an operator by way of the programme control device. At least one cleaning programme is provided; it is preferable for multiple selectable cleaning programmes to be provided.

From the hydraulic diagrams illustrated in the drawings, it can be seen that, furthermore, a final rinse pump 14 is connected by way of its suction side to an outlet of a boiler 22. The boiler 22 furthermore has an inlet which is connected to a fresh water supply line 30, via which either fresh water, or fresh water with dosed final rinse agent, is supplied to the boiler 22. In the boiler 22, the liquid (pure fresh water or fresh water with dosed final rinse agent) supplied via the inlet is heated up in accordance with a process sequence. By way of the final rinse pump 14, which is connected by way of its suction side to the boiler outlet, the final rinse liquid that is heated up in the boiler 22 can be supplied, for example during a fresh water final rinse phase, via the final rinse line system 17 to the final rinse nozzles 15.1 and 15.2. The final rinse nozzles 15.1 and 15.2 are arranged in the treatment zones 6, 7 of the treatment chamber 2 in order to spray the final rinse liquid, which has been heated up in the boiler 22, onto the items of washware in the corresponding treatment zone 6, 7 of the treatment chamber 2. It is self-evidently also conceivable for the boiler 22 to be supplied with pure fresh water via the inlet into the fresh water supply line 30, which pure fresh water has a final rinse agent dosed into it after the heating process in the boiler 22.

Also, in this context, it is conceivable for the final rinse system to have a preferably electrically operated steam generator, which may for example be integrated into the boiler 22. In this case, at the upper region of the boiler 22, there may be formed a corresponding steam outlet of the steam generator (not illustrated in the drawings). Via a steam line, the steam outlet of the steam generator may be connected, at a position situated above the wash tank, to the treatment chamber in order to introduce steam, which has been generated in the steam generator, into said treatment chamber as required. Other positions are however self-evidently also possible.

In the boiler 22, which according to some embodiments of the invention serves not only for heating the final rinse liquid but also for the generation of steam as required, there is situated a heater 47. Furthermore, in or at the boiler 22, there may be arranged a level sensor which, for example, controls a valve 49 of the fresh water line 30.

Figure 6:
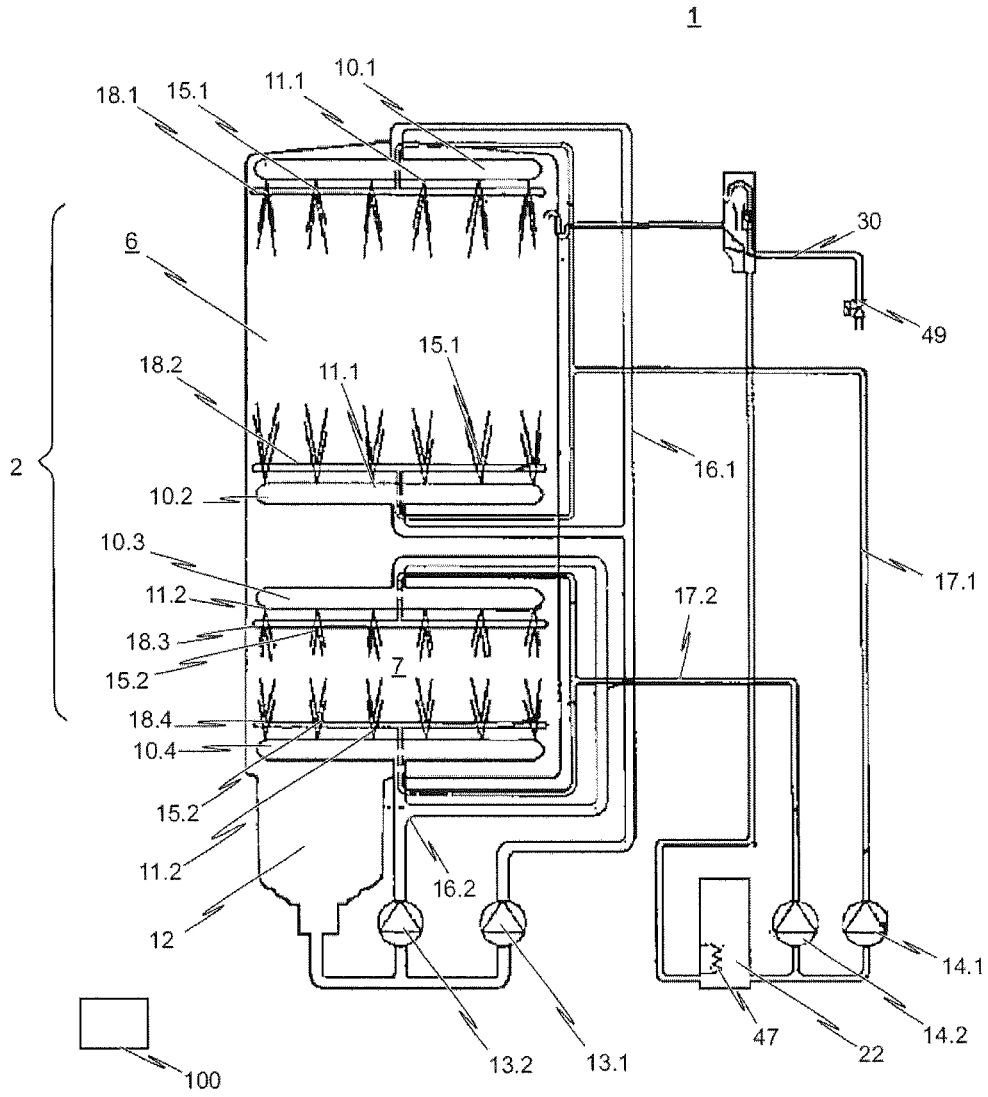
FIG. 6 schematically shows a hydraulic diagram of a wash system of a dishwasher, designed as a batch dishwasher, according to a further embodiment of the present invention.

From the hydraulic diagram illustrated in FIG. 6, it can furthermore be seen that each individual treatment zone 6, 7 may also be assigned a dedicated wash system and a dedicated final rinse system. By contrast to the embodiments shown in FIGS. 4 and 5, it is the case here that the treatment zone 6 is assigned a dedicated wash pump 13.1 and a dedicated wash liquid system 16.1 and also a dedicated final rinse pump 14.1 with a dedicated final rinse line system 17.1. In the same way, the treatment zone 7 is assigned a dedicated wash pump 13.1 and a dedicated wash liquid system 16.2 and also a dedicated final rinse pump 14.2 with a dedicated final rinse line system 17.2. Here, the wash pumps 13.1, 13.2 and the final rinse pumps 14.1, 14.2 are controllable independently of one another by a control device (not shown) such that different treatment programmes can be implemented in the respective treatment zones independently of one another.

Specifically, the control device 100 that is schematically indicated in FIGS. 4 to 6 serves for the control of the correspondingly controllable components of the wash and/or final rinse system of the dishwasher 1. In particular, the control device 100 is designed to control the preferably common wash pump 13 of the wash system such that the wash cycle of each treatment cycle in the first treatment zone 6 is uninterrupted in terms of time, whereas the wash cycle of a single treatment cycle in the second treatment zone 7 is intermittent.

Furthermore, in the exemplary embodiments of the dishwasher 1 according to the invention illustrated in the drawings, the control device 100 is furthermore designed to control the preferably common wash pump 13 such that wash liquid is always sprayed simultaneously in the first and in the second treatment zone 6, 7.

With regard to the final rinse system of the dishwasher 1, the control device 100 is designed to control the two final rinse pumps 14.1, 14.2 such that a final rinse cycle in the second treatment zone 7 always takes place simultaneously, or at least with a time overlap, with respect to a final rinse cycle in the first treatment zone 6.

Here, it is advantageous if the control device 100 is furthermore designed to control the preferably common wash pump 13 such that the time duration of a wash cycle of a single treatment cycle in the second treatment zone 7 corresponds to the total time duration of the wash cycles of a multiplicity of treatment cycles in the first treatment zone 6. In particular, in this context, it is conceivable that, by way of the control device 100, the preferably common wash pump 13 is controlled such that the time duration of a wash cycle of a single treatment cycle in the second treatment zone 7 is an integer multiple of the time duration of a wash cycle in the first treatment zone 6.

In the embodiments of the dishwasher 1 according to the invention illustrated in the drawings, provision is basically made for the control device 100 to be designed to control the at least one wash system and/or the at least one final rinse system such that a wash cycle in the second treatment zone 7 is automatically, preferably selectively automatically, interrupted if at least one of the following conditions is met:

- a final rinse cycle is taking place in the first treatment zone 6; and/or
- the first treatment zone 6 is opened or is not closed, which can be detected for example by way of a corresponding sensor; and/or
- the second treatment zone 7 is opened or is not closed, which can likewise be detected for example by way of a corresponding sensor.

The control of the wash system and/or final rinse system is preferably performed automatically. In other words, the control of the at least one wash and/or final rinse system is preferably performed in accordance with a preset programme sequence, wherein, in the control device 100, there is stored at least one preset programme sequence for the first treatment zone 6 and/or the at least one second treatment zone 7. It is preferable for a multiplicity of preset programme sequences for the first treatment zone 6 and/or the at least one second treatment zone 7 to be stored in the control device 100.

In this context, it is conceivable that, in the control device 100, there is stored at least one programme sequence group with a fixed programme sequence for the first treatment zone 6 and a fixed programme sequence for the at least one second treatment zone 7. Here, the operator of the dishwasher 1 can optionally select one programme sequence from the multiplicity of preset programme sequences for the first treatment zone 6 and, independently of this, can select one programme sequence from the multiplicity of preset programme sequences for the at least one second treatment zone 7, or can select a preset programme sequence group.

It is advantageously the case that, in the control device 100, there is stored at least one programme sequence group with a fixed programme sequence for the first treatment zone 6 and a fixed programme sequence for the at least one second treatment zone 7, and wherein the programme sequences of the programme sequence group are selected in a manner dependent on at least one of the following factors:

- a quantity of items of washware that is primarily encountered, per unit of time, in a standard situation; and/or
- the different types of items of washware that are primarily encountered, per unit of time, in a standard situation; and/or
- a level of soiling of the items of washware that is primarily encountered in a standard situation.

It is furthermore preferable if, in the control device 100, there is stored at least one programme sequence group with a fixed programme sequence for the first treatment zone 6 and a fixed programme sequence for the at least one second treatment zone 7, wherein the programme sequence group has, for the first treatment zone 6, a programme sequence in which the time duration for a wash cycle of the first treatment zone amounts to 40 to 70 seconds, 70 to 120 seconds or 2 to 5 minutes, and wherein the programme sequence group has, for the at least one second treatment zone 7, a programme sequence in which the time duration for a wash cycle in the second treatment zone 7 is identical to the time duration for a wash cycle in the first treatment zone 6.

On the other hand, it is preferable if, in the control device 100, there is stored at least one programme sequence group with a fixed programme sequence for the first treatment zone 6 and a fixed programme sequence for the at least one second treatment zone 7, wherein the programme sequence group has, for the first treatment zone 6, a programme sequence in which the time duration for a wash cycle of the first treatment zone amounts to 40 to 70 seconds, 70 to 120 seconds or 2 to 5 minutes, and wherein the programme sequence group has, for the at least one second treatment zone 7, a programme sequence in which the time duration for a wash cycle in the second treatment zone amounts to 40 to 70 seconds, 70 to 120 seconds or 4 to 10 minutes.

Below, a further embodiment of the present invention will be described in more detail with reference to the illustration in FIG. 7.

As illustrated in the hydraulic diagram in FIG. 7, it is also the case in this embodiment that the (single) wash tank 12 is situated below the treatment chamber 2 of the machine 1 and serves for receiving liquid that has been sprayed in the respective treatment zones 6, 7 of the treatment chamber 2. As is also the case in the other embodiments illustrated in the drawings, it is provided in the embodiment of the dishwasher 1 according to the invention schematically illustrated in FIG. 7 that the treatment chamber 2 of the dishwasher 1 is divided into a total of two treatment zones 6, 7, specifically a main treatment zone 6 and an auxiliary treatment zone 7.

Figure 7:
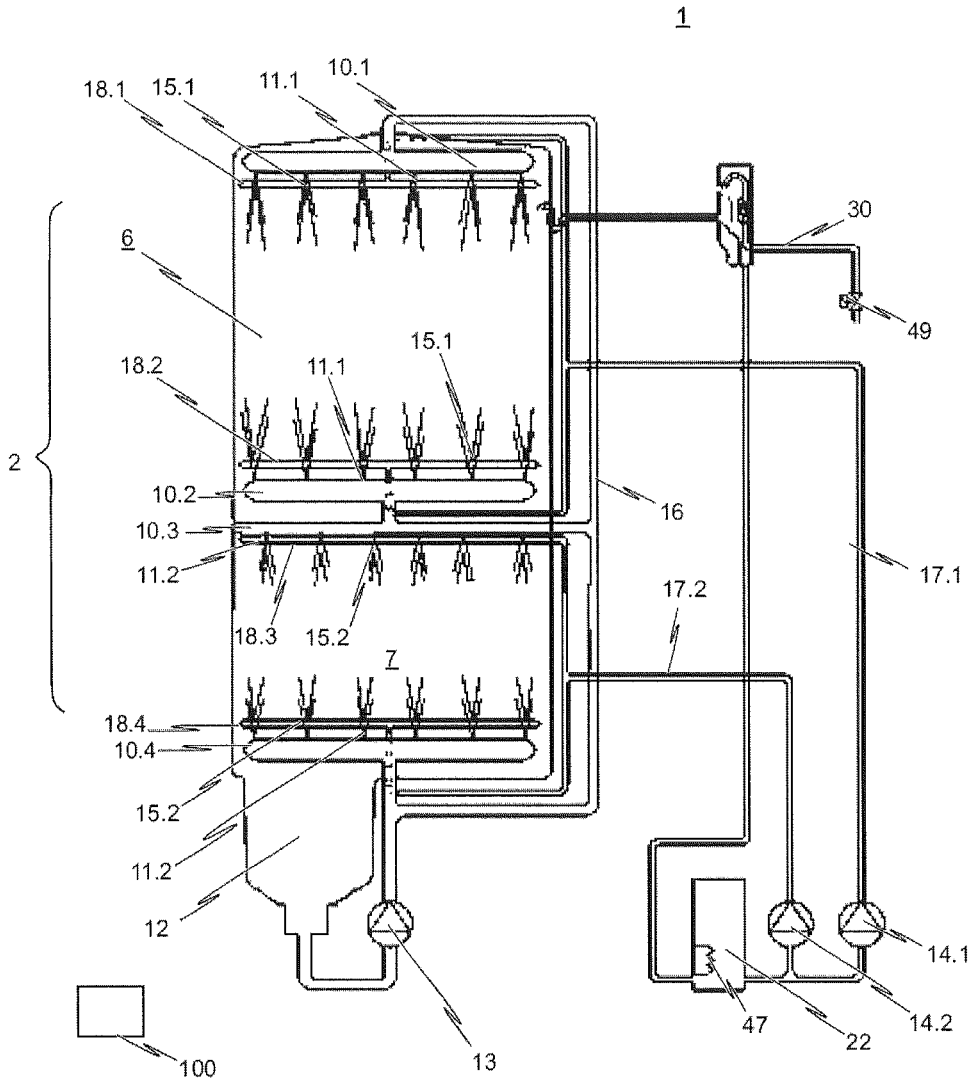
FIG. 7 schematically shows a hydraulic diagram of a wash system of a dishwasher, designed as a batch dishwasher, according to a further embodiment of the present invention.

It is also the case in the embodiment schematically illustrated in FIG. 7 that the two treatment zones 6, 7 are assigned a common wash system. In the hydraulic diagram illustrated in FIG. 7, said common wash system has a (common) wash pump 13 by way of which wash liquid can be delivered from the wash tank 12 through a wash liquid line system to corresponding wash nozzles 11.1, 11.2.

In the embodiment schematically illustrated in FIG. 7, the wash nozzles 11.1, 11.2 are integrated into corresponding wash arms 10.1, 10.2, 10.3, 10.4. Here, provision is made whereby the upper (main) treatment zone 6 is assigned a first wash arm arrangement composed of an upper wash arm 10.1 and a lower wash arm 10.2. Said two wash arms 10.1, 10.2 are preferably designed to be rotatable relative to the treatment zone 6.

By contrast to the embodiment shown for example in FIG. 4, however, provision is made, in the embodiment as per FIG. 7, whereby the lower wash arm 10.2 is assigned solely and exclusively to the upper (main) treatment zone 6. Accordingly, in this embodiment, the wash arm 10.2 does not perform the dual function described above.

The lower (auxiliary) treatment zone 7 is likewise assigned corresponding wash arm systems. Specifically, and as will be described in more detail below with reference to the illustrations in FIGS. 8A, 8B, 9, 10A and 10B, provision is made, in the exemplary embodiment schematically illustrated in FIG. 7, that the lower (auxiliary) treatment zone 7 is assigned a lower wash arm 10.4 which—like the wash arms 10.1 and 10.2 of the upper (main) treatment zone 6—is in the form of a wash arm which is designed to be rotatable relative to the lower, auxiliary treatment zone 7.

By contrast, in the embodiment illustrated in FIG. 7, for space reasons, the upper wash arm system 10.3 of the lower (auxiliary) treatment zone 7 is in the form of a wash arm system arranged so as to be stationary relative to the treatment zone 7. As will be described in more detail below with reference, for example, to the illustrations in FIGS. 8A and 8B, said wash arm system has multiple wash arms 10.3, wherein said wash arms 10.3 are each designed to be stationary, that is to say non-rotatable, relative to the treatment zone 7. In this way, the upper wash arm system 10.4 can be designed to be particularly compact, and in particular so as to have a small height, such that, for the lower treatment zone 7, as large as possible an (effective) volume is available for the corresponding treatment of items of washware therein.

As is also the case in the embodiment schematically illustrated, for example, in FIG. 4, provision is made, in the embodiment as per FIG. 7, whereby, in the corresponding wash arms 10.1, 10.2, 10.3, 10.4, there are formed wash nozzles 11.1, 11.2 which are directed in each case toward the correspondingly associated treatment zone 6, 7 in the treatment chamber 2 and which serve for spraying the wash liquid, which has been delivered by the common wash pump 13, onto the items of washware which are arranged in the respective treatment zones 6, 7 and which are to be cleaned.

The sprayed wash liquid then falls, under the action of gravitational force, back into the (single) wash tank 12, which in the embodiment illustrated in FIG. 7 has, for example, a capacity of approximately 30 litres. In this way, the wash tank 12, the wash pump 13, the wash liquid line system 16 and the wash nozzles 11.1, 11.2, together with the treatment zones 6, 7 of the treatment chamber 2, form a wash liquid circuit. Here, the wash liquid line system 16 connects the pressure side of the wash pump 13 to the corresponding wash nozzles 11.1, 11.2.

In the embodiment of the dishwasher 1 according to the invention schematically illustrated in FIG. 7, provision is also made of a final rinse system for the delivery of final rinse liquid by way of final rinse pumps 14.1, 14.2 through corresponding final rinse line systems 17.1, 17.2 to final rinse nozzles 15.1, 15.2, which final rinse nozzles are directed, in the treatment chamber 2, in each case in the treatment zones 6, 7, toward the region of the items of washware to be treated.

As is also the case in the dishwasher 1 schematically illustrated in FIG. 6, provision is made, in the embodiment as per FIG. 7, whereby the upper treatment zone 6 is assigned a dedicated final rinse system composed of a dedicated final rinse pump 14.1 and a dedicated final rinse line system 17.1. In the same way, the lower treatment zone 7 is assigned a dedicated final rinse system composed of a dedicated final rinse pump 14.2 and a dedicated final rinse line system 17.2. Here, the two final rinse pumps 14.1, 14.2 can be controlled by a control device 100, which is merely schematically indicated in FIG. 7.

The upper treatment zone 6 is assigned corresponding final rinse nozzles 15.1, to which, during a final rinse phase, fresh water or fresh water with dosed final rinse agent is supplied by way of the final rinse pump 14.1. The final rinse nozzles 15.1 of the upper treatment zone 6 are, like the corresponding wash nozzles 11.1, preferably integrated in final rinse arms which are mounted so as to be rotatable relative to the upper treatment zone 6.

It is preferable for at least some of the final rinse nozzles 15.2 of the lower treatment zone 7 to be designed as final rinse nozzles which are arranged so as to be stationary, that is to say to be formed in a final rinse arm which is arranged so as to be stationary relative to the lower treatment zone 7. In the exemplary embodiment illustrated in FIG. 7, this applies in particular to the final rinse nozzles 15.2 arranged in the upper region of the lower treatment zone 7.

As will be described in detail below with reference to the illustration in FIG. 9, it is the case that, for the lower treatment zone 7, the corresponding final rinse nozzles 15.2 which are arranged there in the upper region are formed in final rinse arms which are integrated in a partition element (partition 50).

The partition element is preferably a partition plate which can be fixed in the treatment chamber 2 and which serves for physically separating the first and second treatment zones 6, 7 from one another in such a way that, when wash liquid in particular is sprayed in one of the two treatment zones 6, 7, recontamination in the other treatment zone 7, 6 which is caused in particular by said spraying operation is effectively prevented.

Figure 8A:
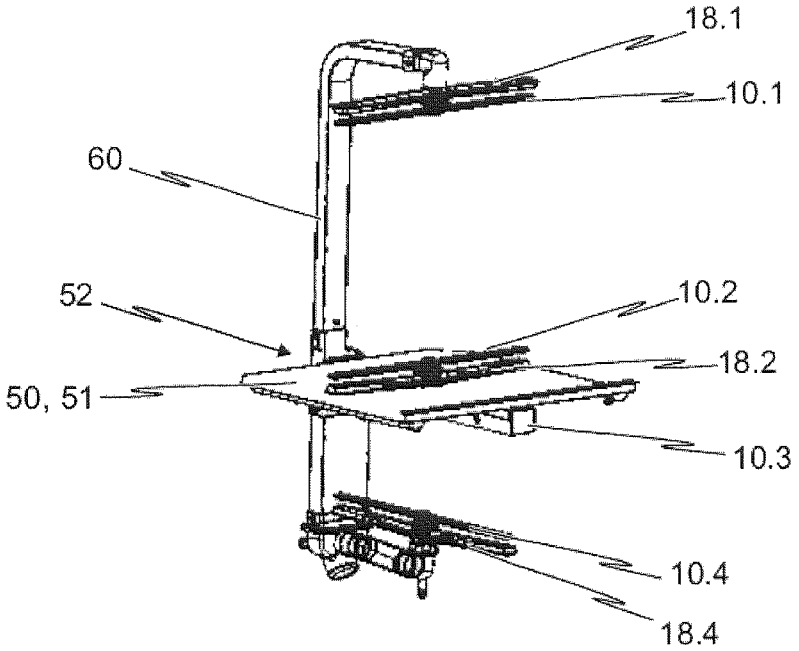
FIG. 8A shows, in a perspective view, the wash system that is used in the dishwasher, designed as a batch dishwasher, according to FIG. 7.
Figure 8B:
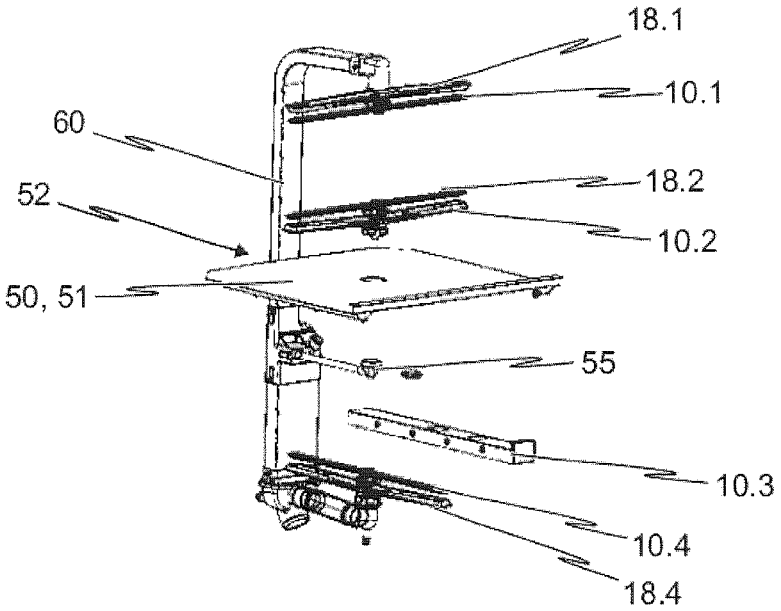
FIG. 8B shows, in a perspective exploded illustration, the wash system that is used in the dishwasher, designed as a batch dishwasher, according to FIG. 7.

Specifically, and as emerges for example from the illustrations in FIGS. 8A and 8B, it is the case in this embodiment that the partition element designed as a partition plate is dimensioned such that preferably the entire effective horizontal cross-sectional area of the treatment chamber 2 is covered, such that the upper and lower treatment zones 6, 7 are physically separated from one another in an effective manner. To nevertheless be able to achieve that, when wash liquid is sprayed in the upper treatment zone 6, the sprayed wash liquid can run back into the (common) wash tank 12 of the dishwasher 1 under the action of gravitational force, provision is made whereby, in at least one region laterally with respect to the wash liquid line system 16 and/or laterally with respect to the final rinse line system 17.1, 17.2, there remains a gap opening 52, which is however not aligned in a vertical direction with the treatment region in the lower treatment zone 7.

Specifically, and as emerges in particular from the illustrations in FIGS. 8A and 8B, provision is made, in this exemplary embodiment, whereby the wash liquid line system 16 and the final rinse line systems 17.1, 17.2 are accommodated, at least in regions, in a common duct housing 60. At the other side, the partition element in the form of a partition plate abuts against said duct housing 60 and is supported/fastened there. In this way, to the left-hand and right-hand sides of the (centrally arranged) duct housing 60, gap openings are provided via which the liquid sprayed in the upper treatment zone 6 can flow off into the common wash tank 12 under the action of gravitational force.

In particular, it also emerges from the illustration in FIGS. 8A and 8B that the upper wash arm 10.3 assigned to the lower treatment zone 7 is designed as a wash arm which is arranged so as to be stationary relative to the treatment zone 7 and in which the corresponding wash nozzles 11.2 are accommodated. In the illustrated embodiment, said upper wash arm 10.3, which is designed to be stationary, of the lower wash zone 7 furthermore serves for the support/fixing of the partition element 51, which is in the form of a partition plate. In this way, a particularly compact structural form is realized, which increases the effective available volume for the treatment of items of washware in the lower treatment zone 7.

It also emerges from the illustrations in FIGS. 8A and 8B that the wash arms 10.1, 10.2 assigned to the upper treatment zone 6 are each in the form of wash arms which are designed to be rotatable relative to the treatment zone 6. The same preferably also applies to the lower wash arm 4 assigned to the lower treatment zone 7.

Figure 10A:
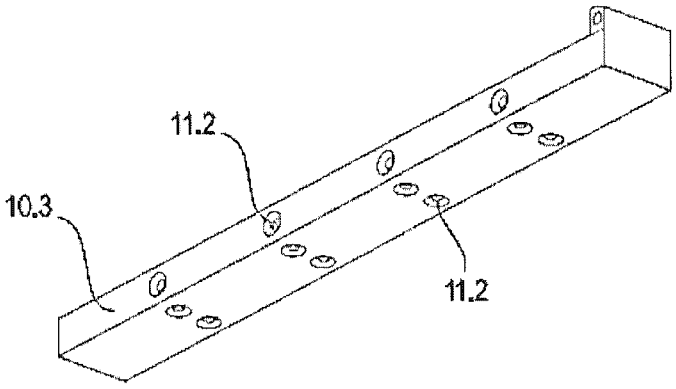
FIG. 10A shows, in a perspective view from below, a stationary wash arm that is used in the wash system according to FIG. 8A and FIG. 8B.
Figure 10B:
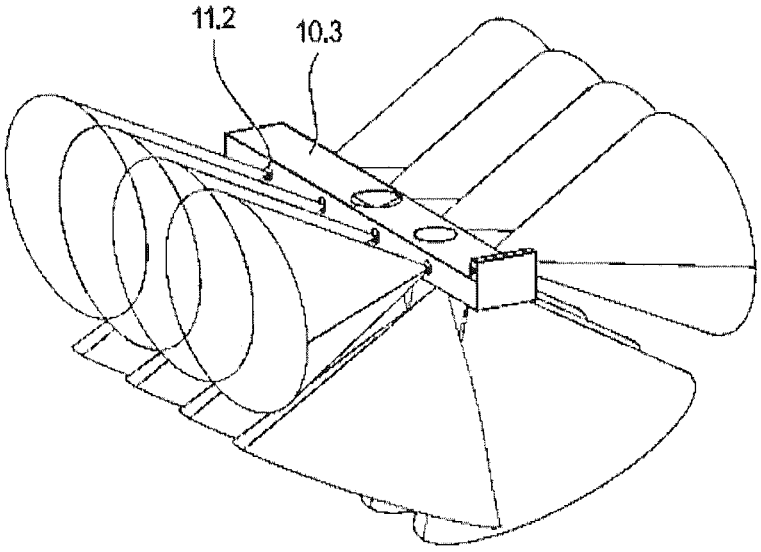
FIG. 10B shows a spray pattern that can be achieved by way of the static wash arm illustrated in FIG. 10A.

The (upper) wash arm 10.3, which is used in this embodiment, of the lower treatment zone 7 is illustrated once again in FIG. 10A, wherein FIG. 10B illustrates the spray pattern that can be realized by way of said wash arm or by way of the wash nozzles integrated in said wash arm.

In order to make it possible for final rinse liquid to be sprayed in the corresponding treatment zones 6, 7 in a final rinse phase, the upper treatment zone 6 is formed with an upper and a lower final rinse arm 18.1, 18.2. Said two final rinse arms 18.1, 18.2 are preferably designed as final rinse arms formed detachably with the corresponding wash arm 10.1, 10.2.

For this purpose, it is for example conceivable for use to be made of a clip mechanism such as is described in DE 20 2014 105 112 U1.

The lower treatment zone 7 is likewise equipped with a rotatable final rinse arm (lower final rinse arm 18.4, which is likewise preferably detachably connectable to the corresponding wash arm 10.4.

Figure 9:
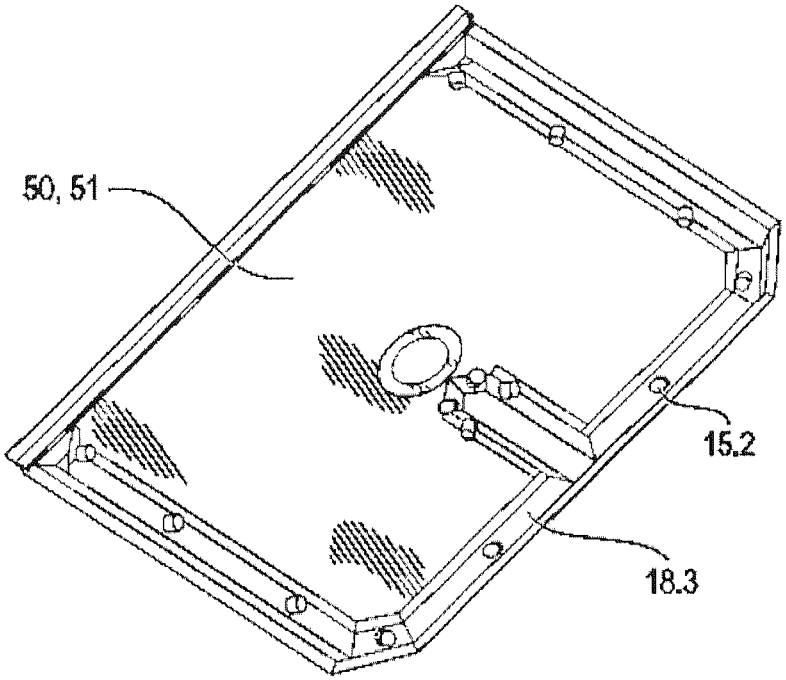
FIG. 9 shows, in a perspective view from below, a partition element which is used in the wash system according to FIG. 8A and FIG. 8B.

Final rinse nozzles are likewise provided in the upper region of the lower treatment zone 7, which final rinse nozzles are however integrated in final rinse arm segments 15.3 which are arranged so as to be stationary relative to the treatment zone 7, as can be seen in particular from the illustration in FIG. 9.

Specifically, in this embodiment which is illustrated by way of example, provision is made whereby corresponding final rinse arm segments are formed on the underside of the partition element 51 in the form of a partition plate, and in particular in the peripheral region of the partition element 51, in order to supply final rinse liquid to the corresponding final rinse nozzles as required.

Below, a further embodiment of the dishwasher 1 in the form of a batch dishwasher will be described with reference to the hydraulic diagram schematically illustrated in FIG. 11.

As illustrated, the dishwasher 1 has a single treatment chamber 2 which is divided into an upper (main) treatment zone 6 and a lower (auxiliary) treatment zone 7. As will be described in more detail below with reference to the illustrations in FIGS. 12 and 15, said two treatment zones 6, 7 are physically separated from one another by way of a partition 50 such that, when wash liquid is sprayed in one of the two treatment zones 6, 7, recontamination in the other treatment zone 7, 6 which is caused in particular by said spraying operation is effectively prevented.

Figure 11:
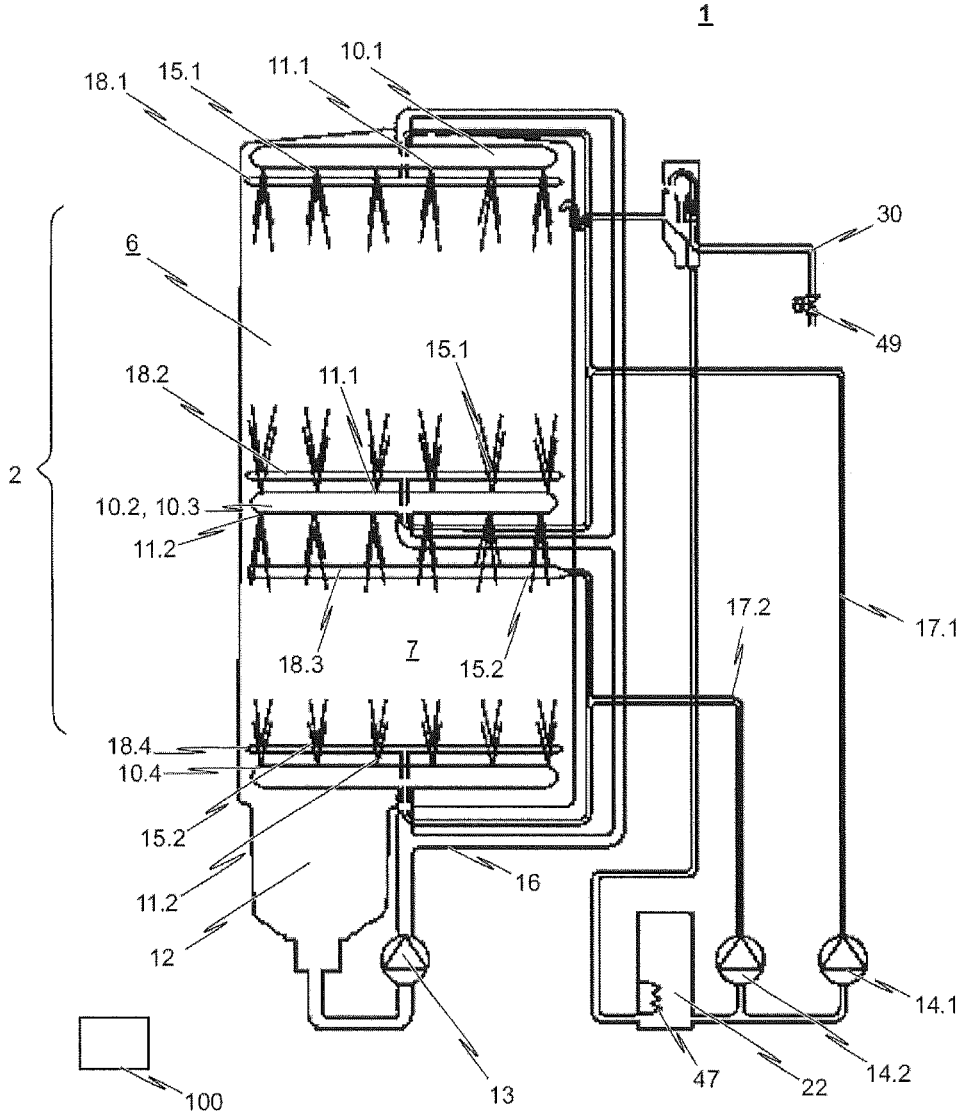
FIG. 11 schematically shows a hydraulic diagram of a wash system of a dishwasher, designed as a batch dishwasher, according to a further embodiment of the present invention.

As is also the case in the embodiment of the dishwasher 1 according to the invention described above, provision is made, in the case of the dishwasher 1 schematically illustrated in FIG. 11, that said dishwasher has only a single wash tank 12, which is assigned to the (single) treatment chamber 2 and which is thus assigned jointly to both treatment zones 6, 7.

The wash tank 12 is situated below the treatment chamber 2 of the dishwasher 1 and serves for receiving liquid that has been sprayed in the respective treatment zones 6, 7. The capacity of the wash tank 12 amounts to 20 to 40 litres, preferably 25 to 35 litres. It is also the case in the embodiment schematically illustrated in FIG. 11 that this capacity is firstly sufficient for simultaneous final rinse operation in both treatment zones 6, 7. Secondly, the wash tank 12 is selected to be so small that it can, as before, be accommodated in the reduced installation space—in relation to a conventional machine which has only a single treatment zone—in the machine housing.

As is also the case in the embodiment described above with reference to the illustration in FIG. 7, provision is made, in the embodiment of the dishwasher 1 schematically illustrated in FIG. 11, that the two treatment zones 6, 7 are assigned a common wash system. Said common wash system has a (single) wash pump 13, by way of which wash liquid can be delivered from the wash tank 12 via a wash liquid line system 16 to corresponding wash nozzles 11.1, 11.2. The wash nozzles denoted by the reference designation "11.1" in FIG. 11 are in this case assigned to the upper treatment chamber 6, and are oriented correspondingly, whereas the wash nozzles denoted by the reference designation "11.2" in FIG. 11 are assigned to the lower treatment zone 7, and are oriented accordingly.

As is also the case in the embodiment of the dishwasher 1 according to the invention illustrated, for example, in FIG. 4, provision is made here whereby the lower wash arm 10.2 of the upper treatment zone 6 and the upper wash arm 10.3 of the lower treatment zone 7 are formed as a common wash arm. In other words, it is also the case in the exemplary embodiment schematically illustrated in FIG. 11 that use is made of a single wash arm 10.2, 10.3 which performs a dual function: said common wash arm serves as a lower wash arm of the (upper) main treatment zone 6 and, at the same time, as an upper wash arm of the (lower) auxiliary treatment zone 7. For this purpose, the common wash arm has wash nozzles 11.1 oriented in the direction of the upper treatment zone 6 and wash nozzles 11.2 oriented in the direction of the lower treatment zone 7.

Different embodiments of said (common) wash arm will be described below with reference to the illustrations in FIGS. 13, 14 and 15.

In addition to said common wash arm, the upper treatment zone 6 is assigned a further wash arm 10.1 which is mounted in the upper region of the treatment zone 6, preferably so as to be rotatable about a vertical axis relative to the treatment zone 6. Corresponding wash nozzles 11.1 are likewise formed in said wash arm 10.1.

In the same way, an additional wash arm 11.4 with corresponding wash nozzles 11.2 is provided in the lower region of the lower treatment zone 7. Like the upper wash arm 10.1 of the upper treatment zone 6, the lower wash arm 10.4 of the lower treatment zone 7 is designed to be rotatable relative to said treatment zone.

In the embodiment of the dishwasher 1 according to the invention schematically illustrated in FIG. 11, each treatment zone 6, 7 is assigned a dedicated final rinse system, such that a final rinse process can be performed in the treatment zones 6, 7 independently of one another. For this purpose, each final rinse system has a dedicated final rinse pump 14.1, 14.2, wherein said final rinse pumps 14.1, 14.2 are each connected, at the suction side, to a boiler 22. Via a corresponding final rinse line system 17.1, 17.2, the pressure-side outlet of the corresponding final rinse pump 14.1, 14.2 is connected in terms of flow to the final rinse nozzles 15.1, 15.2 respectively assigned to the treatment zones 6, 7.

As will be described in more detail below with reference to the illustrations in FIGS. 12 to 15, the final rinse nozzles 15.1 assigned to the upper treatment zone 6 are each formed in a final rinse arm 18.1, 18.2. By contrast, for example, to the embodiment schematically illustrated in FIG. 4, said two final rinse arms 18.1, 18.2 are assigned solely and exclusively to the upper treatment zone 6.

It is preferably the case that the final rinse arms 18.1, 18.2 of the upper treatment zone 6 are designed to be rotatable relative to said treatment zone. In particular, a solution such as is described—at least in principle—in the document DE 20 2014 105 112 U1 is expedient here.

By contrast, the final rinse nozzles 15.2 assigned to the lower treatment zone 7 are preferably formed in final rinse arms 18.2 which are arranged so as to be stationary relative to the treatment zone 7. In this way, it is possible for the final rinse nozzles 15.2 to be integrated in the lower treatment zone 7 in as space-saving a manner as possible.

Figure 12:
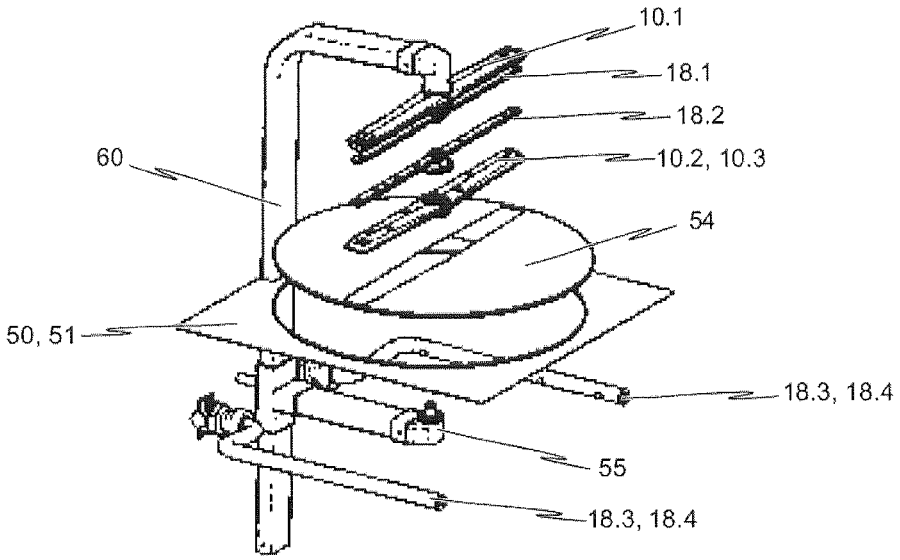
FIG. 12 shows, in a perspective exploded illustration, an exemplary embodiment of a wash system that is used in the dishwasher, designed as a batch dishwasher, according to FIG. 11.

As can be seen for example from the exploded illustration in FIG. 12, it is conceivable that, for example in the lower region of the lower treatment zone 7, there are provided laterally arranged (stationary) final rinse arms 18.2, in which the corresponding final rinse nozzles 15.2 are formed.

It is however self-evidently also conceivable for the final rinse arms 18.2 to be provided in other regions of the lower treatment zone 7, in particular in a central arrangement, wherein then, the final rinse nozzles 15.2 formed in the final rinse arms 18.2 should be oriented both upward and downward.

It also emerges from the illustration in FIG. 12 how, in this exemplary embodiment, the partition 50, by way of which the upper and lower treatment zones 6, 7 are physically separated from one another, may be formed. Specifically, in this exemplary embodiment, the partition 50 has a partition element 51 which extend substantially in a horizontal plane and which is designed such that—with the exception of a centrally arranged recess—it covers the entire effective cross-sectional area of the treatment chamber 2.

For this purpose, in the rear region of the partition element 51, there is provided a recess 53 which is designed so as to be adapted to the duct housing 60 of the final rinse line system or wash liquid line system.

Figure 13:
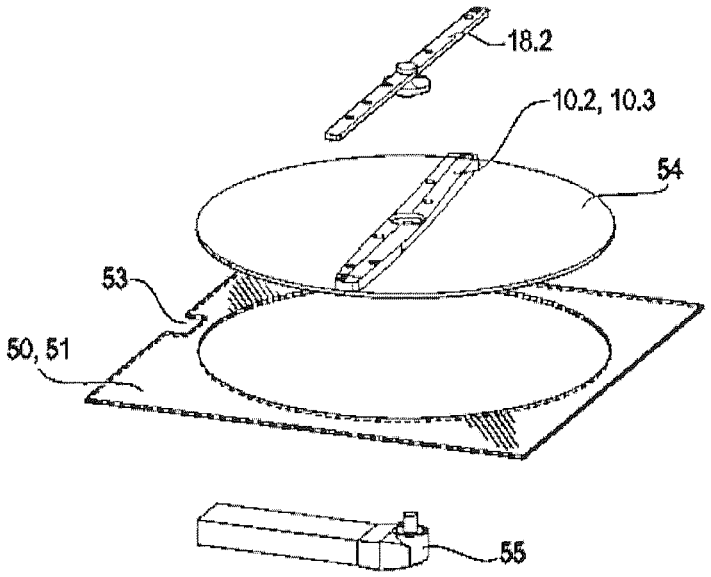
FIG. 13 shows, in a perspective exploded illustration, a partition element that is used in the wash system illustrated in FIG. 12.
Figure 14:
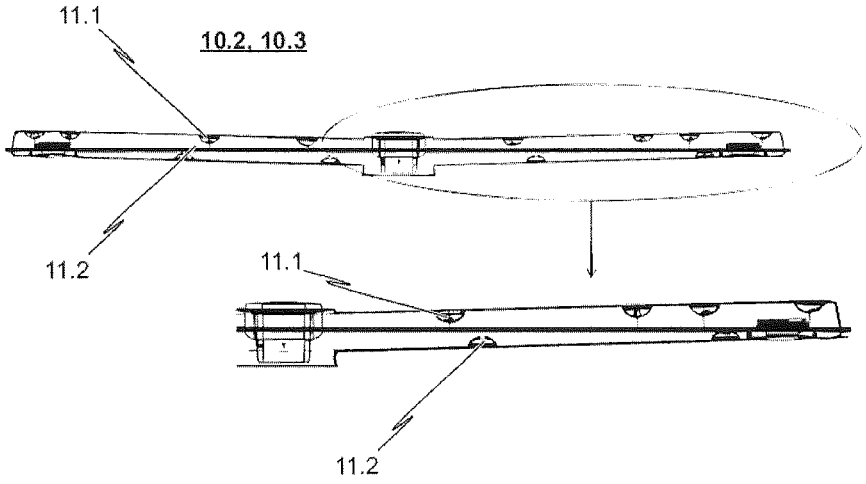
FIG. 14 shows, in a side view, a common wash arm that is used in the wash system as per FIG. 12.

As emerges in particular from the illustration in FIG. 13, it is however the case that a recess is formed centrally in the partition element 51, in which recess there can be inserted a disc-shaped partition 54. Said disc-shaped partition 54 is preferably fixedly connected to the (common) wash arm and, by way of a final rinse or wash liquid connector 55, mounted so as to be rotatable in a horizontal plane.

Figure 15:
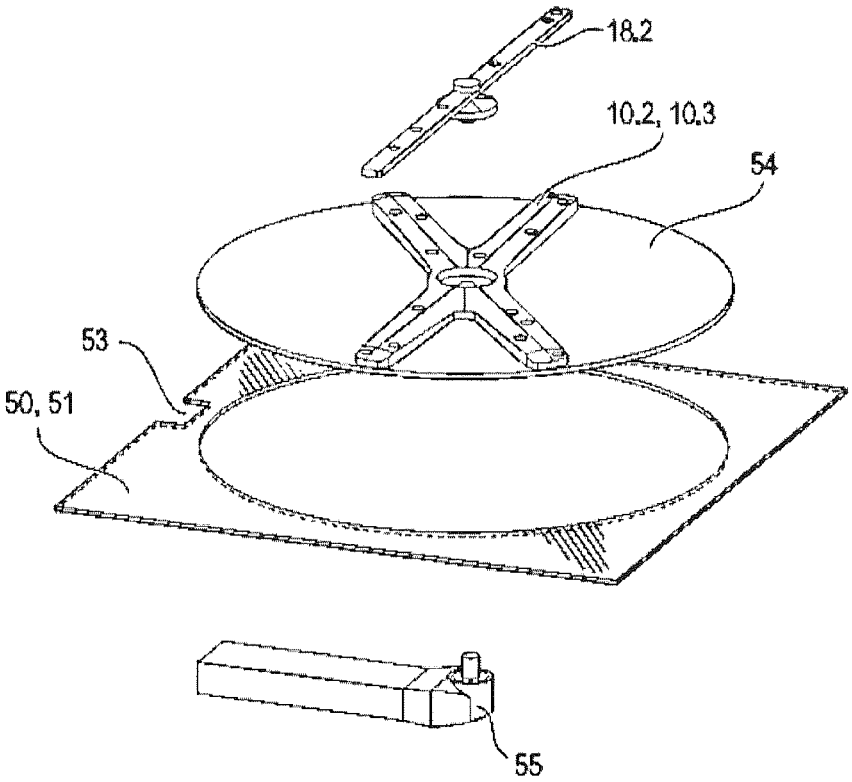
FIG. 15 shows a further embodiment of a partition element for the wash system used in the dishwasher, designed as a batch dishwasher, as per FIG. 11.

FIG. 15 shows an alternative embodiment of the dishwasher 1 schematically illustrated for example in FIG. 11. In this embodiment, use is again made of a disc-shaped partition 54, wherein, however, the common wash arm has a total of four wash arm segments.

Below, with reference to the illustration in FIG. 16, a description will be given of an exemplary embodiment of a user interface 110 by way of which an operator of the dishwasher 1 according to the invention can select at least one treatment programme or corresponding treatment parameters for the first and/or second treatment zone 6, 7.

Figure 16:
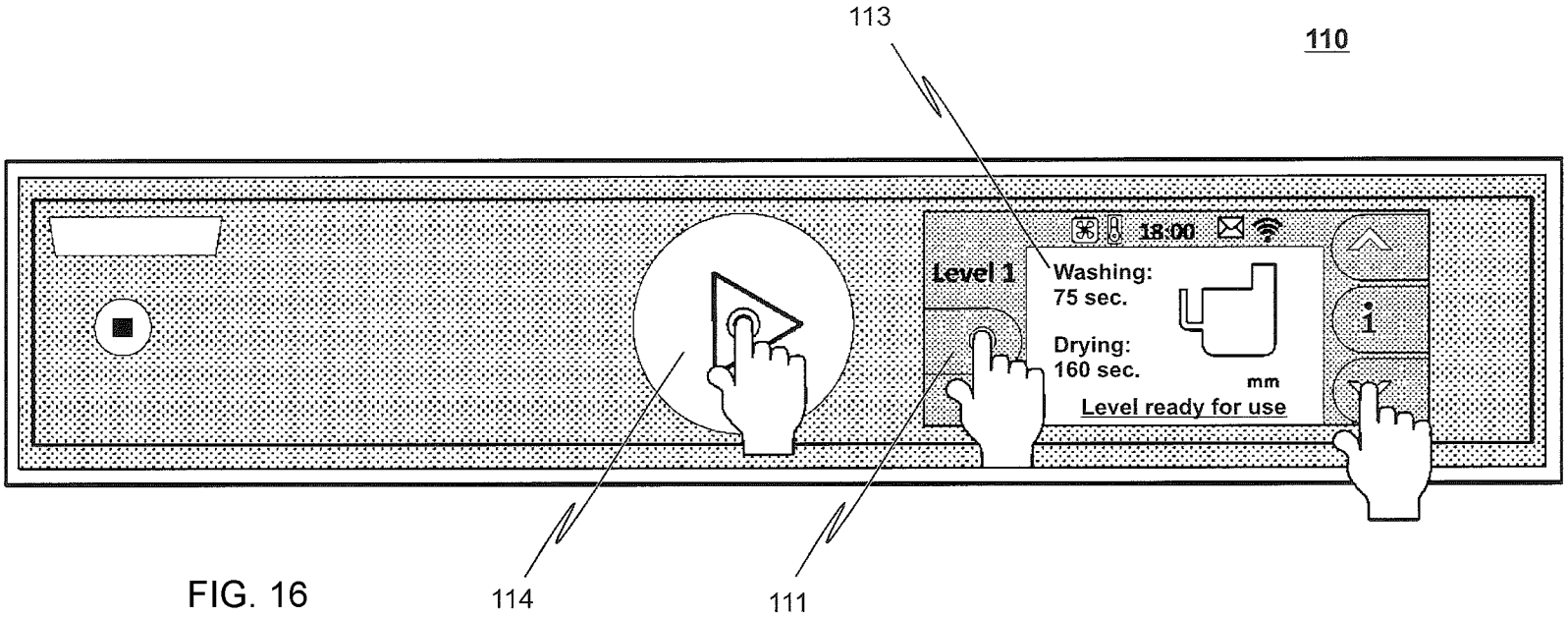
FIG. 16 shows an embodiment of a user interface for the dishwasher according to the invention.

Specifically, the embodiment of the user interface 110 illustrated in FIG. 16 is designed as a common user interface for both treatment zones 6, 7 of the dishwasher 1. As emerges from the illustrations in FIGS. 1 to 4, said common user interface 110 is arranged in the upper region of the slidable hood 8.

The present invention is self-evidently not restricted to embodiments in which a common user interface 110 is used for all treatment zones 6, 7 of the dishwasher 1. In particular, it is conceivable for in each case one user interface to be provided for the first and at least one second treatment zones 6, 7. Here, it would be expedient for the user interface 110 for the first treatment zone 6 to be arranged in the upper region of the hood 8 and for the user interface 110 for the at least one second treatment zone 7 to be arranged above the door 9, which is formed separately from the hood 8.

As indicated in FIG. 16, the user interface 110 is designed to provide information regarding a system state of the dishwasher 1. In the illustration of FIG. 16, this is realized optically by way of a corresponding information panel 113.

Furthermore, the user interface 110 is equipped with an input panel 111 in order to enable the user to manually intervene in a treatment cycle of the first treatment zone 6 and/or in a treatment cycle of the at least one second treatment zone 7.

In particular, the user interface 110 schematically illustrated in FIG. 16 is equipped with a first, manually actuable input panel 114, for the purposes of starting or ending a treatment cycle in the first and/or at least one second treatment zone 7, and with a second input panel 111, which is formed separately from the first input panel 114 and which serves the purposes of accessing information relating to a system state of the dishwasher 1 and/or intervening in a treatment cycle of the first and/or at least one second treatment zone 7, and/or accessing or selecting programme parameters for the first and/or at least one second treatment zone 7.

In summary, it is accordingly evident that the solution according to the invention provides at least one additional treatment zone 7, specifically in particular for items of washware, such as cutlery or GN containers, which are generally relatively heavily soiled and which thus require a relatively long washing duration. In this way, the washing performance can be improved by virtue of the programme duration of the additional treatment zone 7 being lengthened, specifically to the extent required for the type of washware to be treated in said treatment zone 7 in order to ensure a flawless washing result. In addition to this, despite the use of the intensive programme in the additional treatment zone 7, the capacity of the main wash zone 6 is not adversely affected, that is to say is not reduced.

For example, by way of the main treatment zone 6, it is possible for five racks to be treated using a standard treatment programme while, furthermore, in the lower or additional treatment zone 7, one rack is treated simultaneously, that is to say in parallel therewith, using an intensive treatment program.

It is thus possible for the existing treatment zone 6 to be operated without capacity losses for the normally soiled items of washware in relation to current machines, specifically with a simultaneous improvement of the washing result for relatively heavily soiled items of washware, because these can be cleaned in parallel therewith in the additional treatment zone 7, for example using a special intensive treatment program.

The invention is not restricted to the exemplary embodiments that are illustrated purely by way of example in the drawings, but rather emerges from an overall view of all of the features and aspects disclosed herein.

The invention claimed is:

1. A hood-type batch dishwasher, comprising:

a treatment chamber that is divided into a first treatment zone and a second treatment zone, wherein the first treatment zone is above the second treatment zone, wherein the first treatment zone has a first access opening that can be closed by a hood, and the second treatment zone has a second access opening that is separate from the first access opening and that can be closed by a door that is separate from the hood;

a wash system with a recirculation flow for spraying wash liquid in both the first treatment zone and the second treatment zone, wherein the wash system includes a first plurality of wash nozzles in the first treatment zone, a second plurality of wash nozzles in the second treatment zone, a common wash tank located below the second treatment zone to receive falling wash liquid from both the first treatment zone and the second treatment zone, and a common pump with an input connected to receive wash liquid from the common wash tank and an output connected to feed wash liquid to both the first plurality of wash nozzles and the second plurality of wash nozzles simultaneously when the common pump operates; and a partition positioned to divide the treatment chamber into the first treatment zone and the second treatment zone, the partition configured to prevent sprayed wash liquid of the first treatment zone from contacting wares in the second treatment zone as the sprayed wash liquid of the first treatment zone falls under gravity to the common wash tank below the second treatment zone by diverting the sprayed wash liquid away from a ware holding region of the second treatment zone;

at least one final rinse system for spraying final rinse liquid in the treatment chamber.

2. The dishwasher of claim 1, wherein the at least one final rinse system comprises:

a first final rinse system including a first plurality of final rinse nozzles in the first treatment zone and a first final rinse pump having an output connected to feed final rinse liquid to the first plurality of final rinse nozzles when the first final rinse pump operates;

a second final rinse system including a second plurality of final rinse nozzles in the second treatment zone and a second final rinse pump having an output connected to feed final rinse liquid to the second plurality of final rinse nozzles when the second final rinse pump operates.

3. The dishwasher of claim 2, further comprising a common boiler for heating final rinse liquid, the common boiler connected to deliver final rinse liquid to both an input of the first final rinse pump and an input of the second final rinse pump.

4. The dishwasher of claim 2, wherein at least some wash nozzles of the second plurality of wash nozzles are stationary, and wherein at least some final rinse nozzles of the second plurality of final rinse nozzles are stationary.

5. The dishwasher of claim 4, wherein at least some wash nozzles of the second plurality of wash nozzles are located in a rotatable wash arm, and wherein at least some final rinse nozzles of the second plurality of final rinse nozzles are located in a rotatable rinse arm.

6. A hood-type dishwasher, comprising:

a treatment chamber that is divided into a first treatment zone and a second treatment zone, wherein the first treatment zone is above the second treatment zone, wherein the first treatment zone has a first access opening that can be closed by a hood, and the second treatment zone has a second access opening that is separate from the first access opening and that can be closed by a door that is separate from the hood;

a wash system with a recirculation flow for spraying wash liquid in both the first treatment zone and the second treatment zone, wherein the wash system includes a first plurality of wash nozzles positioned to spray in the first treatment zone, a second plurality of wash nozzles positioned to spray in the second treatment zone, a common wash tank located to receive falling wash liquid from both the first treatment zone and the second treatment zone, and a common wash pump with an input connected to receive wash liquid from the common wash tank and an output connected to feed wash liquid to both the first plurality of wash nozzles and the second plurality of wash nozzles simultaneously when the common wash pump operates;

a partition positioned to divide the treatment chamber into the first treatment zone and the second treatment zone, the partition configured to prevent sprayed wash liquid of the first treatment zone from recontaminating wares in the second treatment zone as the sprayed wash liquid of the first treatment zone falls under gravity to the common wash tank;

a first final rinse system including a first plurality of final rinse nozzles positioned to spray in the first treatment zone and a first final rinse pump having an output connected to feed final rinse liquid to the first plurality of final rinse nozzles when the first final rinse pump operates; and a second final rinse system including a second plurality of final rinse nozzles positioned to spray in the second treatment zone and a second final rinse pump having an output connected to feed final rinse liquid to the second plurality of final rinse nozzles when the second final rinse pump operates.

7. The dishwasher of claim 6, further comprising a common boiler for heating final rinse liquid, the common boiler connected to deliver final rinse liquid to both an input of the first final rinse pump and an input of the second final rinse pump.

8. The dishwasher of claim 6, wherein at least some wash nozzles of the second plurality of wash nozzles are stationary, and wherein at least some final rinse nozzles of the second plurality of final rinse nozzles are stationary.

9. The dishwasher of claim 8, wherein at least some wash nozzles of the second plurality of wash nozzles are located in a rotatable wash arm, and wherein at least some final rinse nozzles of the second plurality of final rinse nozzles are located in a rotatable rinse arm.

10. A hood-type dishwasher, comprising:

a treatment chamber that is divided into a first treatment zone and a second treatment zone, wherein the first treatment zone is above the second treatment zone, wherein the first treatment zone has a first access opening that can be closed by a hood, and the second treatment zone has a second access opening that is separate from the first access opening and that can be closed by a door that is separate from the hood;

a wash system with a recirculation flow for spraying wash liquid in both the first treatment zone and the second treatment zone, wherein the wash system includes a first plurality of wash nozzles in the first treatment zone, a second plurality of wash nozzles in the second treatment zone, a common wash tank located below the second treatment zone to receive falling wash liquid from both the first treatment zone and the second treatment zone, and a common wash pump with an input connected to receive wash liquid from the common wash tank and an output connected to feed wash liquid to both the first plurality of wash nozzles and the second plurality of wash nozzles simultaneously when the common wash pump operates;

a partition positioned to divide the treatment chamber into the first treatment zone and the second treatment zone, the partition configured to prevent sprayed wash liquid of the first treatment zone from recontaminating wares in the second treatment zone as the sprayed wash liquid of the first treatment zone falls under gravity to the common wash tank below the second treatment zone; and at least one final rinse system for spraying final rinse liquid in the treatment chamber.

11. The dishwasher of claim 10, wherein at least some wash nozzles of the second plurality of wash nozzles are stationary and at least some wash nozzles of the second plurality of wash nozzles are located in a rotatable wash arm.

12. The dishwasher of claim 10, wherein the at least one final rinse system comprises:

a first final rinse system including a first plurality of final rinse nozzles in the first treatment zone and a first final rinse pump having an output connected to feed final rinse liquid to the first plurality of final rinse nozzles when the first final rinse pump operates;

a second final rinse system including a second plurality of final rinse nozzles in the second treatment zone and a second final rinse pump having an output connected to feed final rinse liquid to the second plurality of final rinse nozzles when the second final rinse pump operates.

13. The dishwasher of claim 12, further comprising a common boiler for heating final rinse liquid, the common boiler connected to deliver final rinse liquid to both an input of the first final rinse pump and an input of the second final rinse pump.

14. The dishwasher of claim 12, wherein at least some final rinse nozzles of the second plurality of final rinse nozzles are stationary and at least final rinse wash nozzles of the second plurality of final rinse nozzles are located in a rotatable rinse arm.

* * * * *